United States Patent [19]

Rupert et al.

[11] Patent Number: 5,022,222

[45] Date of Patent: Jun. 11, 1991

[54] PROCESS AND DEVICE FOR PIECING YARN TO AN OPEN-END SPINNING DEVICE

[75] Inventors: Karl Rupert; Walter Mayer; Hubert Lochbronner, all of Ingolstadt, Fed. Rep. of Germany

[73] Assignee: Schubert & Salzer Maschinenfabrik Aktiengesellschaft, Fed. Rep. of Germany

[21] Appl. No.: 526,530

[22] Filed: May 18, 1990

Related U.S. Application Data

[63] Continuation of Ser. No. 255,468, Oct. 11, 1988, abandoned.

[30] Foreign Application Priority Data

Oct. 13, 1987 [DE] Fed. Rep. of Germany ..... 3734565

[51] Int. Cl.[5] ..... D01H 4/50

[52] U.S. Cl. ..... 57/263

[58] Field of Search ..... 57/22, 261, 263, 264, 57/266, 268, 276, 404, 269

[56] References Cited

U.S. PATENT DOCUMENTS

| | | | |
|---|---|---|---|
| 3,858,385 | 1/1975 | Shinkai et al. | 57/263 |
| 4,107,957 | 8/1978 | Stahlecker et al. | 57/263 |
| 4,109,450 | 8/1978 | Yoshida et al. | 57/263 |
| 4,120,140 | 10/1978 | Raasch et al. | 57/34 R |
| 4,150,532 | 4/1979 | Ligones | 57/263 |
| 4,356,692 | 11/1982 | Karl et al. | 57/263 |
| 4,489,544 | 12/1984 | Morita et al. | 57/261 |
| 4,494,371 | 1/1985 | Morita et al. | 57/263 |
| 4,539,803 | 9/1985 | Ferro et al. | 57/263 |
| 4,561,242 | 12/1985 | Stahlecker | 57/263 |
| 4,563,872 | 1/1986 | Stahlecker | 57/263 |
| 4,598,539 | 7/1986 | Stahlecker et al. | 57/263 |
| 4,716,718 | 1/1988 | Göbbels et al. | 57/263 |
| 4,817,380 | 4/1989 | Lovas | 57/263 |

FOREIGN PATENT DOCUMENTS

| | | |
|---|---|---|
| 3220713 | 2/1983 | Fed. Rep. of Germany . |
| 1528642 | 10/1978 | United Kingdom . |

*Primary Examiner*—Joseph J. Hail, III

*Attorney, Agent, or Firm*—Dority & Manning

[57] ABSTRACT

A device and process for piecing yarn on an open-end spinning device where a yarn is fed back either from the winding bobbin on which it had been wound previously, during the spinning process, or from a special piecing bobbin via a common back-feeding path to the spinning device. The piecing yarn, drawn off from the piecing bobbin, as well as the yarn drawn off from the winding bobbin is first subjected to the effect of a controllable draw-off action at the beginning of this common back-feeding path upon completion of the piecing process. The yarn, which continues to be delivered by the spinning device, is subjected to the effect of normal spinning draw-off only upon reaching the full draw-off speed and is transferred to an empty tube located in the winding device, whereby the excess yarn segment with the piecing joint is severed and removed when replacing the winding bobbin. A feeding device with a pair of auxiliary rollers is provided to feed the piecing yarn to a back-feeding device, whereby a roller of the pair of auxiliary rollers can be assigned to the bobbin lifted off from the winding roller as a drive roller and can be driven by means of a controllable drive.

41 Claims, 14 Drawing Sheets

40
401
400
402
403
4
411
412
410
413
33
404
50
30
3
431
430
432
43
42
41
540
51
200
54
53
420
421
5
18
24
520
52
20
19
2
121
12
10
11
135
15
14
120
132
130
13
16
1
131
134
17
133

401
40
400
402
403
4
411
412
410
413
33
404
50
30
3
431
430
432
43
42
41
540
51
200
54
53
420
421
5
18
24
520
52
20
19
190
2
121
12
120
14
15
135
132
131
130
13
134
16
11
1
17
133

401
40
400
402
403
4
411
412
410
33
413
404
50
30
3
431
430
31
432
43
42
41
540
51
200
54
53
420
421
5
18
24
520
20
2
19
190
132
135
15
14
12
121
120
11
16
1
130
13
134
131
17
133

PROCESS AND DEVICE FOR PIECING YARN TO AN OPEN-END SPINNING DEVICE

This is a continuation of application Ser. No. 07/255,468, filed Oct. 11, 1988, which was abandoned upon the filing hereof.

BACKGROUND OF THE INVENTION

The instant invention relates to a process for piecing yarn in an open-end spinning device, in which the yarn is fed back to the spinning device either from a winding device, in which it has first been wound up on a bobbin during the spinning process, or from a special piecing bobbin, as well as to a device for carrying out this process.

In open-end spinning machines, yarn breakage caused by plant trash particles such as husk parts, etc., in the fiber sliver occur from time to time and must be repaired. This is accomplished, by having the end of the broken yarn fed back from the bobbin to the spinning device where it is combined with the fibers fed to a fiber collecting surface.

Another situation occurs when the bobbin is to be replaced. In that case, piecing is carried out in the same manner as for a yarn breakage, by feeding the broken yarn back from the bobbin before replacement of the full bobbin by an empty bobbin tube, or by using an auxiliary yarn which is drawn from a special piecing bobbin. The piecing yarn is cut in the course of the piecing process, whereby the yarn section connected to the newly spun yarn and containing the piecing joint is severed from the subsequently delivered, newly spun yarn end is removed, and the subsequently delivered yarn is fed to the new former (See EP-OS 0.106.809). In order to achieve controlled piecing joints, the piecing yarn is inserted immediately into the pair of draw-off rollers when it is fed back and drawn off by the latter at production speed.

During piecing the yarn is subjected to very high acceleration, so that when high production speeds are used many yarn breakages occur or piecing becomes entirely impossible. Since the draw-off rollers are in proximity of the fiber collecting surface the twist imparted to the piecing yarn can distribute itself over only a short length of yarn so that over-twisting of the yarn can easily occur. This is yet another reason why the known device tends to cause yarn breakage. Since, as a rule, many identical spinning devices are installed next to each other in today's open-end spinning machines, a lowering of the speed is possible only for all adjoining spinning devices in common, and this has negative effects upon the yarn produced, and upon the quantity produced.

SUMMARY OF THE INVENTION

The object of the invention is to provide a method and a device for ensuring reliable piecing of the yarn in a simple manner after a yarn is broken or when a full bobbin is replaced with an empty bobbin without affecting other spinning devices on an open-end spinning machine.

This object is attained by the invention, in that the yarn drawn off from the special piecing bobbin is brought back into proximity of the winding device in its piecing/back-feeding phase, from where it is fed back along a back-feeding path that is identical with the back-feeding path of the yarn drawn off from the bobbin to the spinning device, and in that, following completion of a piecing process, the yarn drawn off from the piecing bobbin is first subjected to the effect of a controllable draw-off action in the proximity of the winding device and is removed and in that the subsequently fed yarn is subjected to the effect of normal spinning draw-off, and is transferred to an empty bobbin holder located on the winding device only when full draw-off speed has been reached, whereby the excess yarn section together with the piecing joint is cut off. Since one and the same path is provided for the back-feeding of the yarn drawn off from the bobbin as well as for the piecing yarn drawn off from the piecing bobbin, starting in the area near the winding device, where the yarn to be fed back normally leaves the bobbin during yarn breakage repair, it is also possible to use the device which causes the yarn to be drawn off during yarn breakage repair when the special piecing yarn must be drawn off again after piecing is completed, so that a simple device suffices for this. This device is located at the end of this common back-feeding path, so that the twist imparted to the pieced yarn can distribute itself over a long yarn section, insofar as the propagation of twist is not braked in some other way. This piecing draw-off is controlled as a function of applicable spinning conditions and in this process, is finally brought to the speed of normal spinning draw-off. The yarn can now be transferred to the machine without impairment of yarn quality. The piecing joint which constitutes a faulty point is removed in this process.

In order to avoid uncontrolled drawing off of the piecing yarn from the piecing bobbin and to obtain controlled guidance of the piecing yarn even before feeding for the purpose of piecing has begun, it is advantageous to provide braking for the piecing yarn while it is being drawn off from the piecing bobbin.

The goal of achieving controlled piecing delivery of the piecing yarn is favored by providing for the piecing yarn to be conveyed mechanically from a readiness position into the common back-feeding path. A mechanical feeding device, which holds the piecing yarn, is moved to the beginning of the common back-feeding path to feed the piecing yarn. In order to be able to carry out this motion without additional synchronization with mechanical devices upstream of this mechanical feeding device, a yarn loop is formed by the piecing yarn upstream of the mechanical feeding device after it has been fed to the mechanical feeding device, the yarn loop is used up later in the course of the movement of the feeding device to the beginning of the common back-feeding path.

In a preferred version of the process according to the invention, the piecing yarn is clamped between the piecing bobbin and the mechanical feeding device, after a sufficient length of piecing thread for piecing having been fed, and is cut between that point and the mechanical feeding device, and the free end of the yarn segment extending towards the mechanical feeding device is held pneumatically, is severed after piecing and transfer of the pieced yarn to the bobbin, and is removed pneumatically.

In order to achieve secure transfer of the pieced yarn to the bobbin it is necessary to first draw off the pieced yarn from the spinning device by means of a mechanical feeding device, and then to transfer it to a pair of spinning draw-off rollers located between the spinning device and the feeding device, to then reduce the yarn draw-off speed produced by the mechanical feeding device so that it is lower than the yarn draw-off speed produced by the pair of draw-off rollers to form a loop from the excess of yarn, then to cut the yarn between the loop and the feeding device and to remove the severed yarn end while the yarn which is connected to the spinning device is transferred to the bobbin.

A particularly advantageous piecing method according to the instant invention is that when piecing is to be effected in connection with a bobbin replacement, the piecing yarn is conveyed mechanically into an air stream which introduces the piecing yarn into the open nip of a pair of auxiliary rollers, in that the piecing yarn is then stopped near its leading end, and in that a yarn loop is formed of the piecing yarn which continues to be fed, in that the continued feeding of the piecing yarn is then interrupted and the pair of auxiliary rollers is brought within range of a suction air stream with its nip closed and with the yarn loop being used up, in that the piecing yarn is then fed back with its leading end in the readiness position within the spinning device by the drive of the pair of auxiliary rollers and through the synchronous drawing off of the piecing yarn from the piecing bobbin and the formation of a piecing reserve, whereupon the piecing yarn is severed, in the conveying direction, in front of the pair of auxiliary rollers, and in that the yarn end extending towards the pair of auxiliary rollers is subjected to a suction air stream, in that piecing is then carried out through resumption of fiber releasing and feeding of the piecing yarn reserve, in that the pieced yarn is then drawn off at increasing speed by means of the pair of auxiliary rollers from the spinning device and is fed to the suction air stream in that, thereupon, the pieced yarn is transferred to a pair of draw-off rollers between the spinning device and the pair of auxiliary rollers and in that a yarn loop is then formed between the pair of auxiliary rollers and the pair of draw-off rollers by slowing down the pair of auxiliary rollers, the yarn loop being held pneumatically and being severed from the yarn end extending to the suction air stream so that this yarn end is removed, whereupon the newly obtained yarn end is transferred to the empty bobbin holder which has been inserted in the meantime.

It has proven to be advantageous to carry out bobbin replacement in two steps in the case of a batch replacement, whereby the full bobbin is ejected from the winding device in a first step and the empty holder is inserted into the winding device only after introduction of the piecing process using the piecing yarn drawn off from the piecing bobbin following the preparation of the spinning device involved for a new batch.

To ensure that yarn repair following yarn breakage, in connection with a bobbin replacement does not fail because of insufficient yarn on the holder which was newly inserted during bobbin replacement, another advantageous version of the process according to the invention provides, in connection with the bobbin replacement, for the supervision of the piecing process for a certain period of time following the transfer of the pieced yarn to the empty holder, and for the spinning device to be stopped in case that the yarn breakage occurs during that period of time, for the windings wound on the empty holder during the preceding piecing process to be wound back off the holder and for a new piecing to be carried out by means of the piecing yarn drawn off from the piecing bobbin without effecting another bobbin replacement.

To be able to detect a piecing fault at an early point in time, the yarn itself is preferably monitored within the framework of supervision of the piecing process, the monitoring taking place preferably near the winding device. It is especially necessary for the yarn to be monitored for axial movement.

To carry out the process the invention provides for the feeding device with a pair of auxiliary rollers, one roller of which can be assigned as the drive roller to the bobbin lifted off the winding roller, and which is capable of being driven by means of a controllable drive. During the repair of the yarn breakage, the roller of the pair of auxiliary rollers which is assigned to the bobbin, drives the bobbin during the period of piecing back-feeding of the yarn from the bobbin as well as during the piecing draw-off, whereby the rotational speed of the drive roller is selected as a function of the prevailing conditions. The same roller also supplies the piecing yarn drawn off from the piecing bobbin, returning it to the spinning device, and subsequently ensures controlled piecing draw-off. In this manner, whichever yarn is being delivered to the spinning device for piecing, it is possible to always achieve the optimal adaptation to the fiber material to be spun. Excessively twisted piecing joints and yarn breakage are thus avoided. Thick and thin spots in the piecing joint, which often lead to yarn breakage, can also be avoided, in this manner, to a great extent.

To achieve simple construction and a simple feeding movement, the roller which is also the driver roller for the bobbin is mounted on the free end of a pivoting lever.

For the pair of auxiliary rollers to be able to take up the piecing yarn easily and rapidly on the one hand and for the yarn held by the pair of auxiliary rollers, on the other hand, to be released quickly if necessary, another advantageous embodiment of the invention provides for the roller of the pair of auxiliary rollers which does not contact the bobbin, to be capable of being lifted off from the roller which is used as drive roller for the bobbin.

When conical bobbins are produced it is necessary for the contact surface of the drive roller to be parallel to the casing surface of the bobbin. This would require that, depending on the conicity of the bobbin, the drive roller of the pair of auxiliary rollers, and thereby the pair of auxiliary rollers as a whole, would have to assume different positions. In order to avoid this, it is possible to provide for the drive roller of the pair of auxiliary rollers to be replaceable and to be provided with a first longitudinal segment which interacts with the bobbin and which has a configuration that is adapted to the bobbin, and with a second longitudinal segment with which the other roller of the pair of auxiliary rollers interacts. In this manner the pair of auxiliary rollers can always be oriented in the same direction in relation to the bobbin since different bobbin configurations (cylindrical or of various conicities) can be provided for by replacing the drive roller of the pair of auxiliary rollers with a roller of the appropriate configuration.

To ensure that the part of the drive roller of the pair of auxiliary rollers which interacts with the other roller does not come into driving contact with the bobbin without it being necessary for the pair of auxiliary rollers to extend laterally over the bobbin end, thus requiring more space, provision can be made for the first longitudinal segment to have a greater diameter than the second longitudinal segment, and for the drive of the pair of auxiliary rollers to be controllable so that the circumferential speed of the first longitudinal segment during repair of yarn breakage is equal to the circumferential speed of the second longitudinal segment during piecing in connection with a bobbin replacement. In case of a conical configuration of the first longitudinal segment, the cylindrical second longitudinal segment follows preferably the larger diameter of the first longitudinal segment. In this manner, even with relatively small diameter differences at the point of transition between the two longitudinal segments, it is ensured that the bobbin cannot come to bear against the second longitudinal segment.

The presenting device is preferably provided with a yarn retention device. Such a yarn retention device ensures that the piecing yarn to be transferred to the feeding device can be delivered in a controlled manner. In this manner, reliable transfer of the piecing yarn to the feeding device is ensured on the one hand, and excessive yarn consumption is prevented on the other hand. Reliable and defined transfer of the piecing yarn to the feeding device ensures a high degree of piecing security.

The presenting device can, in principle, be made in different ways. Preferably, it is provided with a driven pair of delivery rollers. In order to avoid separate drives for the pair of delivery rollers and the pair of auxiliary rollers, it is advantageous to provide a common drive motor for the pair of delivery rollers and the pair of auxiliary rollers, with which the pair of delivery rollers is connected via a controllable coupling. This coupling makes it possible to convey the piecing yarn by means of the pair of auxiliary rollers in one direction as well as in the other, without additional piecing yarn having to be drawn off from the piecing bobbin by the pair of delivery rollers or having to be fed back to said piecing bobbin.

Although it is, in principle, possible to drive the auxiliary rollers at a slightly faster speed than the delivery rollers, it has been proven advantageous for the driven rollers of the pair of delivery rollers and of the pair of auxiliary rollers to be driven at the same effective circumferential speed.

When the feeding of the piecing yarn to the back-feeding device is effected by means of a movement of the pair of auxiliary rollers in the direction of the back-feeding device, or when the pair of auxiliary rollers returns into its rest position with the clamped piecing yarn upon completion of the piecing process, the distance between presenting device or piecing bobbin and pair of auxiliary roller changes. To compensate for this change in distance, the presenting device is provided with a storage device. In this way, it is possible to avoid that such differences would have to be compensated by a corresponding drive for the pair of delivery rollers, for example.

The storage device can be made in different ways. In a simple, and, therefore, particularly practical design, the storage device is made in the form of a suction air opening which can be activated between the pair of delivery rollers and the pair of auxiliary rollers. This is achieved, for example, in that the suction air opening can be moved into this operating position and can subsequently be returned to a rest position. The feeding device is preferably located between the pair of delivery rollers and the pair of auxiliary rollers. In case that the storage device is made in the form of a suction air opening, the latter is preferably stationary and located near the auxiliary rollers, between the delivery rollers and the auxiliary rollers, and is capable of being controlled by a switch-off device.

If the feeding device is installed between the pair of delivery rollers and the pair of auxiliary rollers, a yarn cutting device is provided before the storage, as seen in direction of conveying, whereby the yarn cutting device is preferably located between the pair of delivery rollers and the storage device.

To avoid having to use complicated parts with corresponding drives and guidance systems to guide the yarn to the pair of auxiliary rollers, a further embodiment of the invention provides for the presenting unit to be equipped with a pneumatic yarn feeder upstream of the pair of auxiliary rollers. In order to use this yarn feeder with little expenditure of air, it is equipped with a yarn guiding pipe extending from the pair of delivery rollers to the pair of auxiliary rollers. Here it is preferable for the suction air opening to open up laterally into the end of the yarn guiding pipe closest to the pair of auxiliary rollers. The yarn cutting device is also preferably located inside the yarn guiding pipe.

To be able to build up a yarn reserve in the suction air opening in a simple manner, so that subsequently, as the pair of auxiliary rollers together with the clamped yarn moves towards the back-feeding device no drive synchronization between the pair of delivery rollers and the pair of auxiliary rollers is necessary, an advantageous embodiment of the invention is provided with a controllable yarn clamp located on the side of the suction opening away from the pair of delivery rollers, near the end of the yarn guiding pipe. By clamping the yarn by means of the yarn clamp, a yarn reserve can be built up in the suction air opening while the piecing yarn continues to be delivered. The yarn reserve being used up thereafter, when the pair of auxiliary rollers has assumed its clamping position, during the movement of the pair of auxiliary rollers in the direction of the back-feeding device. This yarn clamp is preferably located in the yarn guiding pipe, whereby the controllable yarn clamp may be provided with a movable clamping element made of an elastic material, in a simple embodiment of this device.

For simple presentation of the piecing yarn in front of the pair of auxiliary rollers, an advantageous embodiment of the invention provides for the presenting device to comprise a compressed air nozzle directed upon the nip of the pair of auxiliary rollers, capable of being activated between the pair of delivery rollers and the pair of auxiliary rollers. In this case, it is necessary for the compressed air nozzle to be made in the form of an injection nozzle which opens up into the yarn guiding pipe end closest to the pair of delivery rollers.

Since the compressed air nozzle should be active until the piecing yarn enters the nip of the pair of auxiliary rollers and the yarn reserve has been built up in the suction air opening, provisions are made for the drive of the lift-off roller of the pair of auxiliary rollers to be connected, together with the compressed air nozzle, to a common control device by which they are controlled.

To make it possible for the piecing yarn to be brought as far as possible towards the nip of the pair of auxiliary rollers, the end of the yarn guiding pipe closest to the pair of auxiliary rollers is preferably adapted in form to the nip of said pair of auxiliary rollers.

To be able to carry out not only normal piecing or normal bobbin replacement with ensuing, required piecing, a control device is provided with several control programs which can be called up depending on whether a yarn breakage occurs in connection with a bobbin replacement or independently thereof, or whether a bobbin replacement is to be carried out in connection with a replacement of a batch or independently thereof.

The yarn retention device in the above-described embodiment serves at the same time as a conveying means for the piecing yarn and is formed by a pair of delivery rollers. However, it is not necessary for the functions of yarn retention and yarn conveying to be carried out by one and the same element. In a further embodiment of the invention, the yarn retention device is designed as a storage device and the presenting device is provided with a yarn clamp which can be moved from one side of the pair of auxiliary rollers in receiving position to its other side.

To make it possible for piecing defects to be recognized early, so that an unsuccessful piecing operation may be interrupted at an early stage in order to undertake a new piecing operation, a monitoring device is preferably provided for the supervision of the pieced yarn. It has shown to be particularly useful for the monitoring device to be located in a yarn removal device for the removal of the yarn before it is transferred to the winding device, since in that case no additional guiding means are needed. The monitoring device is, in that case, preferably located in the suction air opening through which the piecing joint is removed. In this manner the monitoring device is in proximity of the winding device so that it is able to detect all defects in the yarn path between spinning device and winding device. Monitoring reliability is further increased if, in a further embodiment of the invention, the monitoring device is made so that it is able to distinguish between an axially immobile and an axially mobile yarn.

In the open-end spinning machines used today, equipped with a plurality of adjoining open-end spinning devices, at least one service unit capable of traveling alongside these spinning devices is provided. In an advantageous embodiment of the invention, the piecing bobbin, the presenting device, the feeding device and the back-feeding device are, in that case, installed on this service unit. In order to avoid having to provide a separate source of negative pressure for the suction air opening if a traveling service unit is used, the suction air opening is in that case preferably connected to a source of negative pressure located on the machine.

The instant invention makes it possible to always effect an optimal piecing process in a simple manner, whatever the special conditions. Even when a yarn breakage occurs immediately following a bobbin replacement, piecing by means of a special piecing yarn makes it possible to avoid failure of the following piecing process. The device according to the invention makes it possible to feed the piecing yarn in a defined manner to the spinning device and to resume draw-off after completion of the piecing back-feeding, whereby the special arrangement of the pair of auxiliary rollers and its drive control not only allow for adaptation to the fiber material to be spun, but, also allow for control of yarn thickness in the piecing joint area and in the area following it. In this way a high degree of piecing reliability is achieved. The device according to the instant invention is also simple to control and compact in construction since no elements are installed anywhere in the area between the normal bobbin and the spinning device, and no elements used to feed the piecing yarn to the spinning device are brought into that area. In addition, the device, according to the invention can also be installed on existing piecing devices, since the existing pivoting lever with the pair of auxiliary rollers for the bobbin and its controls need merely be replaced, and the presenting device must be incorporated additionally.

BRIEF DESCRIPTION OF THE DRAWINGS

Embodiments of the invention are explained in greater detail hereinafter through drawings, in which.

DETAILED DESCRIPTION OF THE DRAWINGS

First, the general construction of an open-end spinning device is described with reference to the left side of FIG. 1, where only those devices and elements are shown which are absolutely necessary to understand the different piecing steps.

Figure 1:
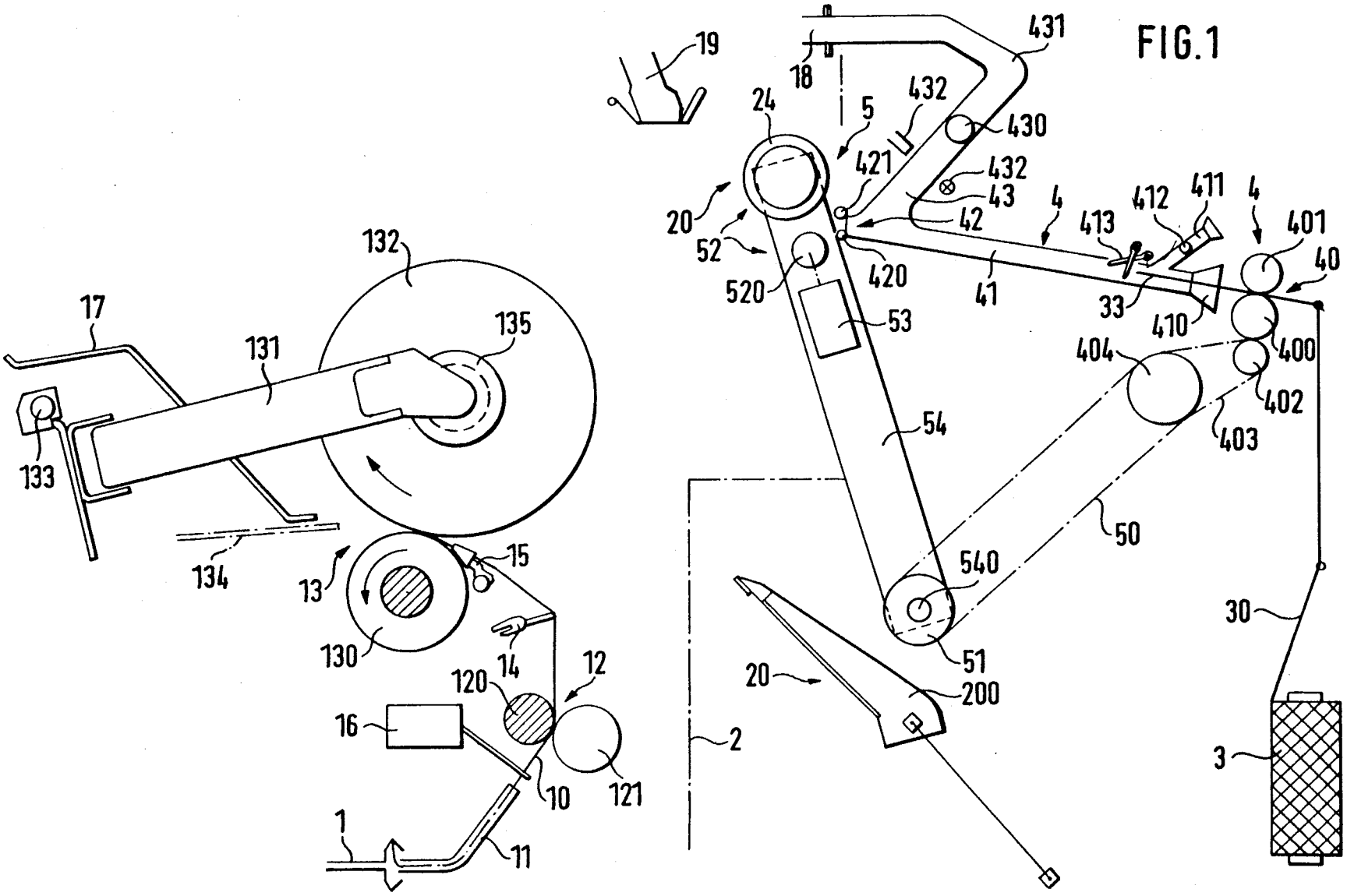
FIGS. 1 shows an open-end spinning device in schematic cross-section as well as a piecing device according to the invention, in the normal spinning position.

In an open-end spinning element which is made in form of a spinning rotor 1 in the embodiment shown in FIG. 1, a yarn 10 is spun, and yarn drawn off through a yarn draw-off pipe 11 by means of a pair of draw-off rollers 12. This pair of draw-off rollers 12 comprises a driven roller 120 as well as a pressure roller 121 capable of being lifted off from the same. On its way to a winding device 13 the yarn 10 runs past a yarn tension equalizing guide 14 as well as a cross-winding yarn guide 15, which is moved back and forth in the manner of a pendulum for the cross-wise distribution of the yarn 10 over a bobbin 132 in the winding device 13. The bobbin 132 is clamped between two bobbin arms 131 which are capable of being pivoted around an axis 133. During spinning operation the bobbin 132 lies against a driven winding roller 130.

The winding device 13 is furthermore equipped with a bobbin lifting device 134 which can be inserted between the winding roller 130 and the bobbin 132. For this purpose the drive device (not shown) for the bobbin lifting device 134 is connected, for control, to a yarn monitor 16 which is located in the path of the yarn near the output opening of the yarn draw-off pipe 11. The bobbin lifting device 134 is also provided with a drive device (not shown) for the piecing device so that the bobbin lifting device 134 can be brought back from its lifting position (shown in FIG. 2) into its starting position shown in FIG. 1. Between the bobbin arms 131, there is a bobbin ramp 17 over and beyond which the full bobbins 132 can be fed to a conveyor belt (not shown) in order to convey the bobbins 132 to a collection location.

Above winding device 13 a bobbin holder or tube conveying device 19 is provided from which the required empty tubes 190 (see FIG. 2) are taken as required for a bobbin replacement.

The right side of FIG. 1 shows part of a piecing device, installed on and carried by a service unit 2. Service unit 2 is capable of traveling alongside a plurality of adjoining spinning stations, each of which comprises a spinning device a yarn monitor 16, a pair of draw-off rollers 12, a yarn tension equalizing guide 14, a cross-winding yarn guide 15, a winding device 13 and a bobbin ramp 17.

Figure 5:
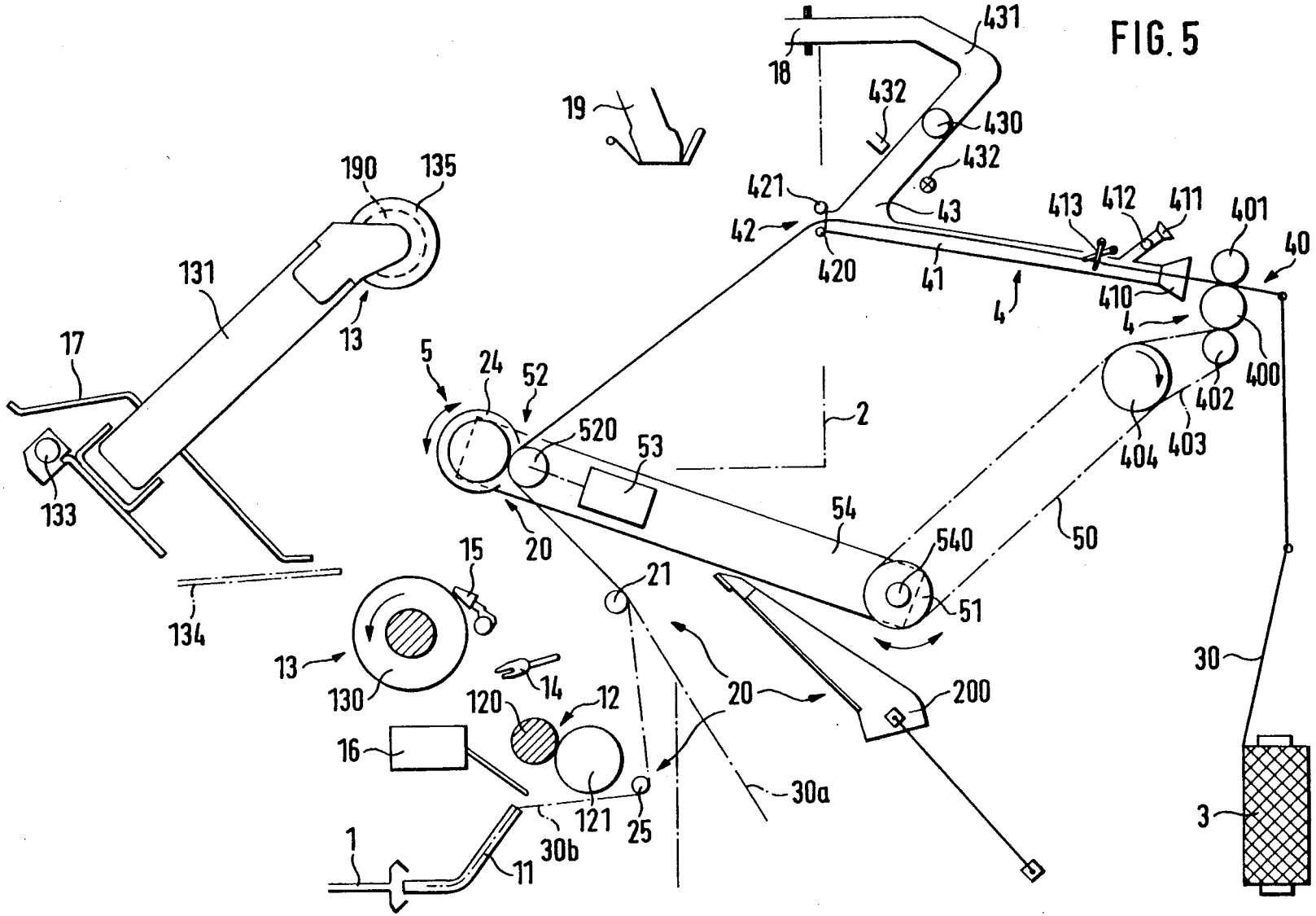

The piecing device located on the service unit 2 is equipped with a back-feeding device 20 (see FIG. 5) is provided with a suction nozzle 200, a centering spindle 21 and a discharge spindle 25 as well as other items. The suction nozzle 200 serves to suck up the end of the broken yarn 10 from bobbin 132 in case of yarn breakage. For this purpose the bobbin 132 is rotated backwards by means of an auxiliary drive roller 24. The suction nozzle 200 is provided (in a known manner) with a slit on its side nearest to the spinning device, from which the yarn which was sucked back finally emerges and is conveyed to a feeding device (not shown) which in turn conveys the yarn 10 to the outlet of a yarn draw-off pipe 11.

The described back-feeding device 20 is not only used when repairing yarn breakage but also in connection with piecing when a bobbin is replaced. This piecing is carried out by means of a piecing yarn 30 which is drawn off from a piecing bobbin 3. The piecing yarn 30 is conveyed by means of a presenting device 4 to a feeding device 5 from which the piecing yarn 30 goes to the back-feeding device 20.

The presenting device 4 is equipped with a pair of delivery rollers 40 of which at least the delivery roller 400 is driven. The other delivery roller 401 does not require its own drive as a rule, but if desired, a direct drive can also be provided for this delivery roller 401. The delivery roller 400 is driven by a drive wheel 402, which itself is driven by a coupler (not shown) by means of a toothed timing belt 403 or similar means by a drive motor 404. Drive motor 404 also drives the feeding device 5, which is provided with a pair of auxiliary rollers 52 as an essential component, by a toothed timing belt 50 or similar device. Auxiliary drive roller 24 is a component of auxiliary rollers 52 and is driven in a manner (which is not shown) by a drive wheel 51 which, in turn, receives its driving force from toothed belt 50. The pair of auxiliary rollers 52 is also equipped with a pressure roller 520 in addition to the auxiliary drive roller 24, the pressure roller 520 is brought to bear against the auxiliary drive roller 24 by means of a magnetic drive 53 if desired, or it can be lifted off auxiliary drive roller 24. The pair of auxiliary rollers 52 is located at the free end of a pivoting lever 54 which also holds the magnetic drive 53, and is supported pivotally on the axis 540 of drive wheel 51.

A yarn guiding pipe 41, which bridges the distance between these pairs of rollers 52 and 40, is located between the pair of auxiliary rollers 52 (shown in its yarn take-up position) and the pair of delivery rollers 40. The yarn guiding pipe 41 is provided at its end closest to the pair of delivery rollers 40 with an opening 410 which widens conically in the direction of the pair of delivery rollers 40, whereby the threading of the piecing yarn 30 into the yarn guiding pipe 41 is facilitated. Shortly after the cone-shaped opening 410, an injection nozzle 411 opens laterally into the yarn guiding pipe 41. Injection nozzle 411 is provided with a valve 412 by means of which the supply of compressed air into the yarn guiding pipe 41 can be controlled.

Near the input into the yarn guiding pipe 41, the latter is provided with a yarn cutting device 413.

Near the end of the yarn guiding pipe 41, on the output side, a yarn clamp 42 is provided, consisting of a stationary part 420 and a lift-off part 421. Near yarn clamp 42, on the side towards the pair of auxiliary rollers 52, a suction opening 43 opens laterally into the yarn guiding pipe 41. This suction opening 43 constitutes a storage and is connected by valve 430 to a suction circuit 431 which is connected to a central negative-pressure source (not shown) by a suction circuit 18 of the open-end spinning machine when the service unit 2 is in operating position.

Figure 8:
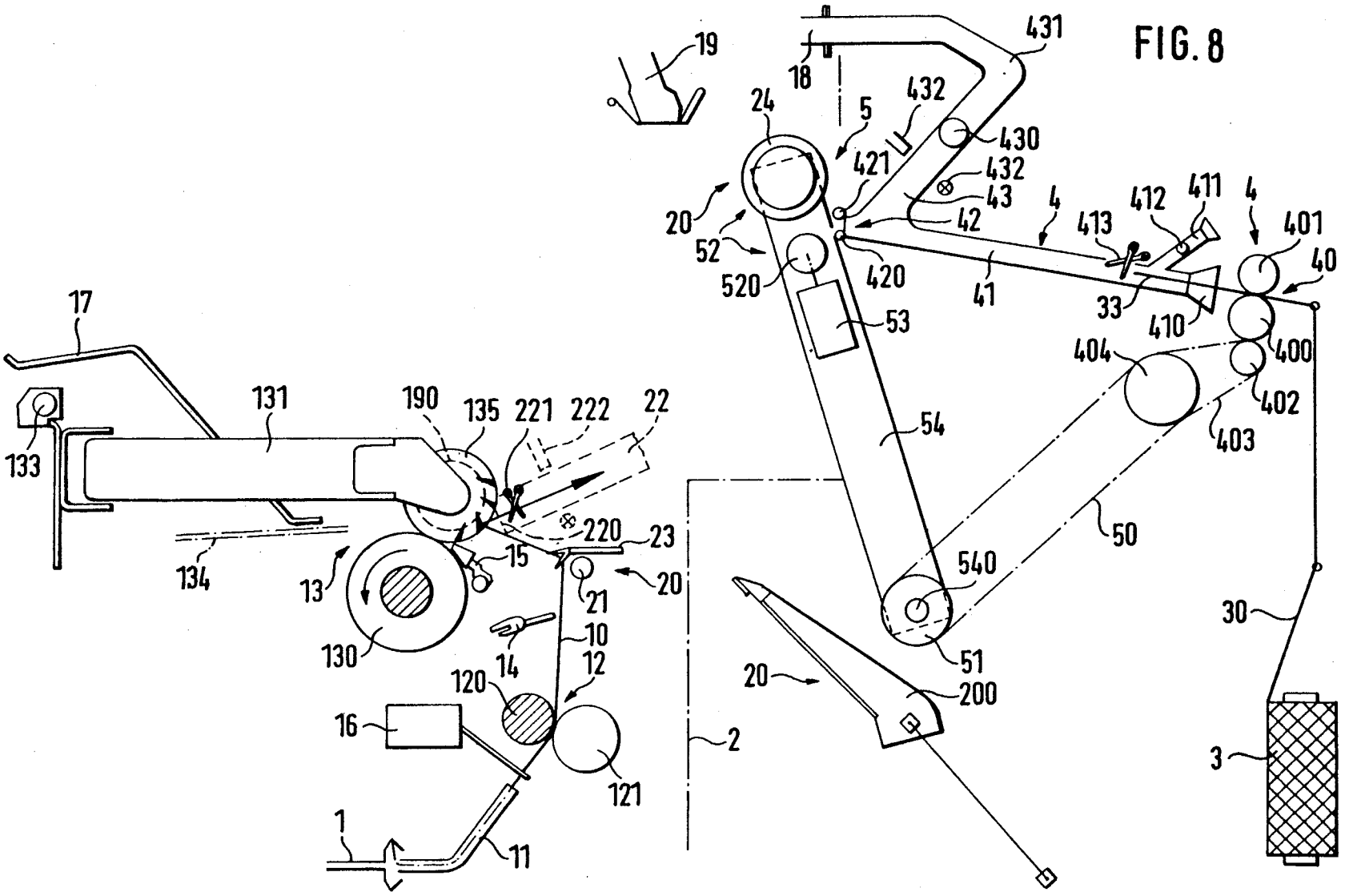

By means of the above-mentioned centering spindle 21 the yarn 10 or the piecing yarn 30 can be brought into such a position that it can be taken up by a suction pipe 22 which can be brought into the path of the yarn (see FIG. 8) and which is connected to the suction circuit 18 in a manner not shown here. On its side closest to the pair of auxiliary rollers 52 to the suction pipe 22 is equipped with a cutting device 221 near its entrance 220. In addition the service unit 2 is equipped with a guiding fork 23, by means of which the pieced yarn can be brought into a favorable position for the transfer to the empty tube 190 inserted into the winding device 13.

The construction of the open-end spinning device and the piecing device having now been described, the function of this installation in connection with bobbin replacement is explained hereinbelow:

At first the spinning station is in a state such as is shown in FIG. 1, on the left. When the bobbin 132 has reached the desired size, this is recorded in a known manner. For example, the revolutions of the rollers 120 of the pair of draw-off rollers from the moment of insertion of the empty former can be counted and compared with a previously defined desired value. When the desired size has been reached, the service unit 2 is stopped in front of this spinning station. A yarn breakage is now produced in a known manner, by interrupting the feeding of fibers into the spinning rotor 1.

At this wanted yarn breakage the yarn monitor 16 is activated and causes the bobbin lifting device 134, which is under spring tension, to be released. This bobbin lifting device 134 now darts forward from its rest position shown in FIG. 1 into its work position between winding roller 130 and bobbin 132, so that said bobbin 132 is separated from its drive.

The piecing yarn 30 is, at that moment, in a waiting position in which it is held by the pair of delivery rollers 40 and extends up to, and into, the yarn guiding pipe 41. When the service unit 2 has recorded that the full bobbin 132 is to be replaced by an empty tube 190 the program for bobbin replacement is initiated.

Figure 2:
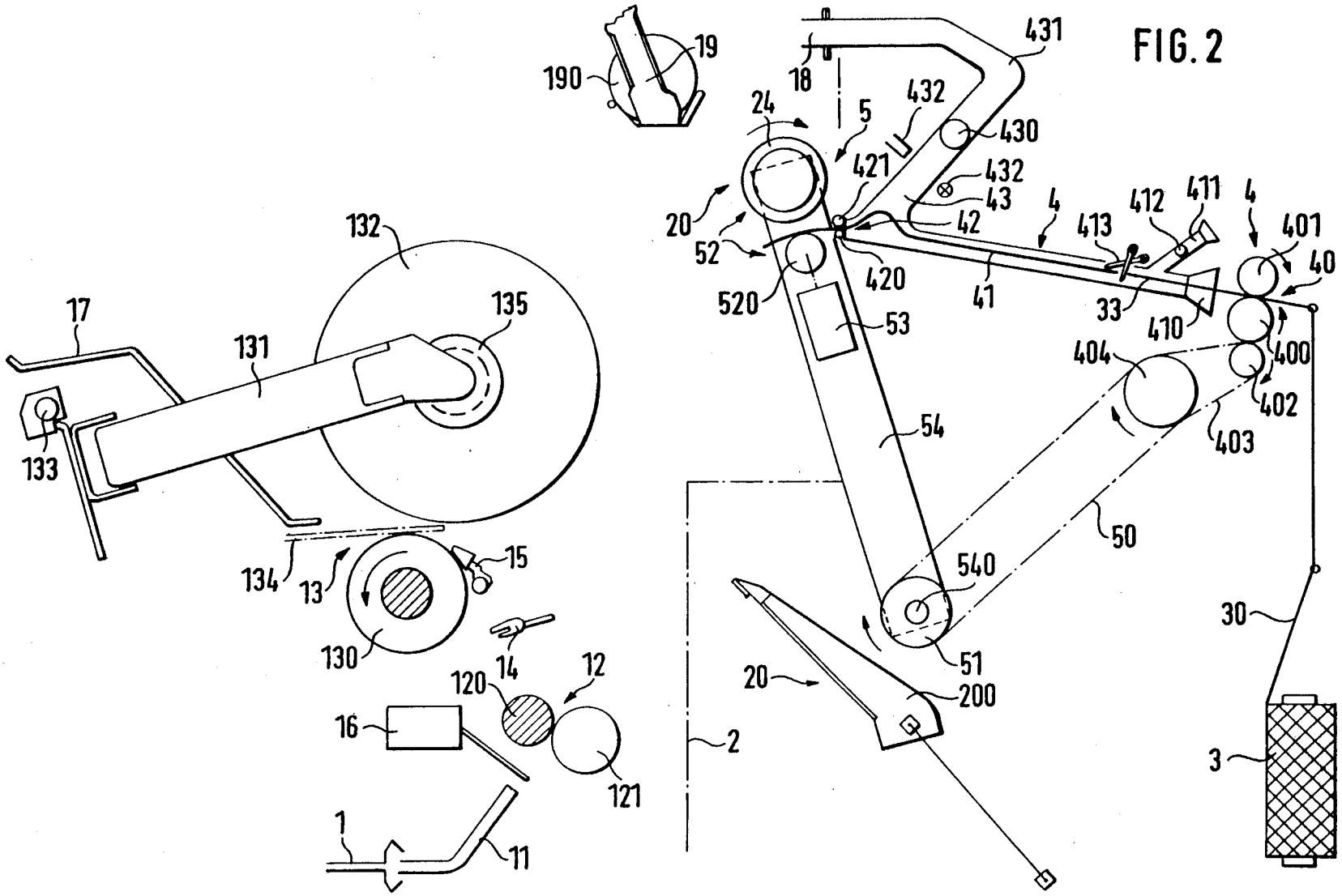
FIGS. 2 to 8 show the device of FIG. 1 in schematic cross-section, in different work phases during a piecing process in connection with a bobbin replacement.

First the piecing motor 404 and the coupling (not shown) of the pair of delivery rollers 40 are switched on so that the pair of delivery rollers 40, as well as the auxiliary drive roller 24 of the pair of auxiliary rollers 52, are driven by toothed belts 403 and 50. At the same time the valve 412 is opened so that compressed air is blown into the yarn guiding pipe 41 through the injection nozzle 411. In this manner, a stream of suction air is produced in the inlet area 410 of the yarn guiding pipe 41 which seizes the piecing yarn 30, even if it should have slipped out of the yarn guiding pipe 41 before. While the piecing yarn 30 is conveyed mechanically through the pair of delivery rollers 40 into this air stream, said air stream ensures that the piecing yarn 30 reaches the yarn clamp 42. The pressure roller 520 is lifted off (at this moment) the auxiliary drive roller 24 of the pair of auxiliary rollers 52, so that the piecing yarn 30 is blown through the pair of auxiliary rollers 52 to its side away from the yarn guiding pipe 41. The yarn clamp 42 is now closed and the piecing yarn 30 is stopped at its leading end. At the same time the opening of the valve 430 produces negative pressure in the suction opening 43. This state is shown in FIG. 2.

Figure 4:
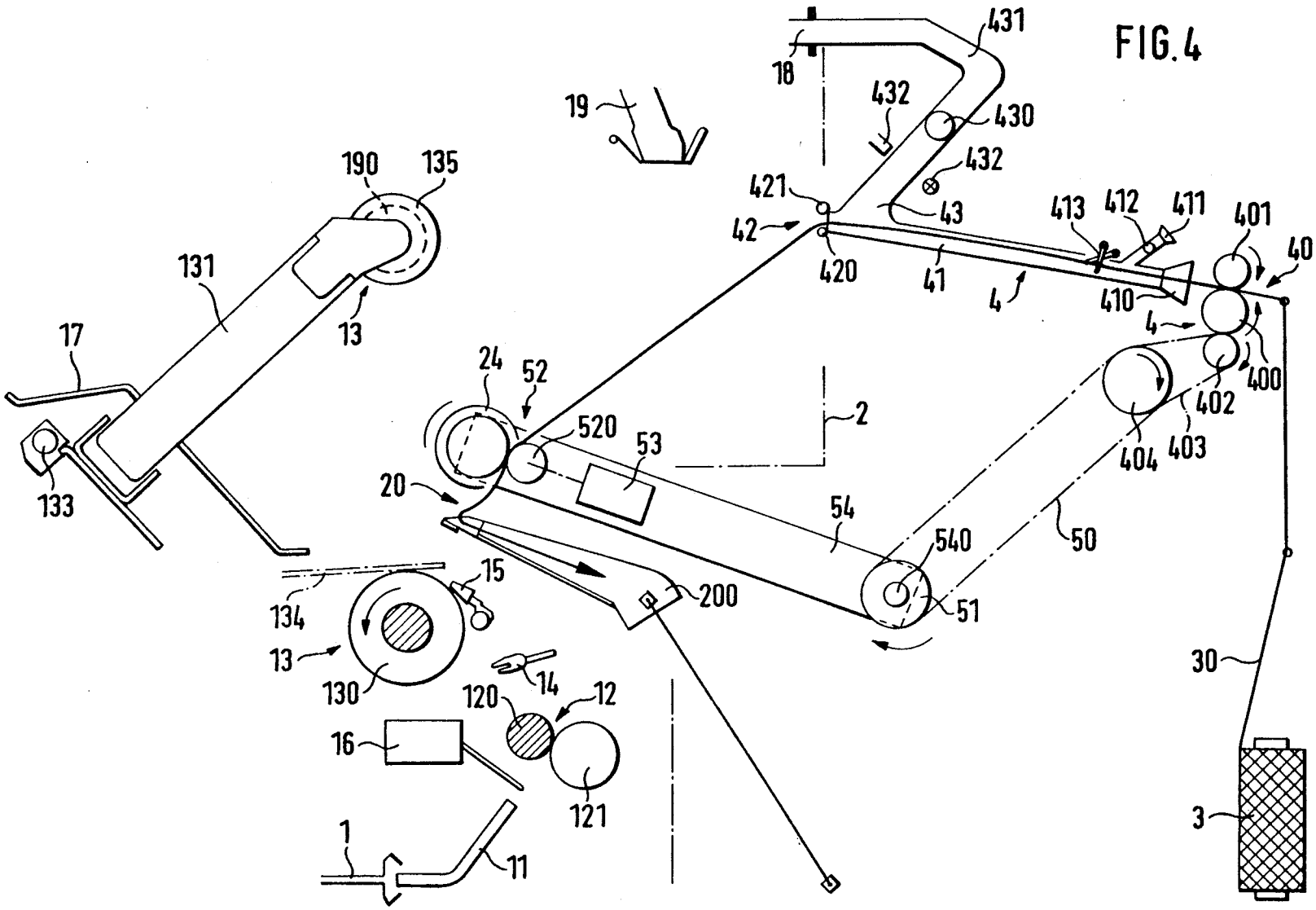

By conventional means (not shown for that reason) the full bobbin 132 is ejected from the bobbin arms 131 and is conveyed over the bobbin ramp 17 to the conveyor belt (not shown). During the ejection of the full bobbin 132 the bobbin arms 131 move into their upper position as shown in FIG. 4. Furthermore, an empty former 190 is taken from the former feeding device 19 (in a known manner) and is inserted into the bobbin arms 131.

Figure 3:
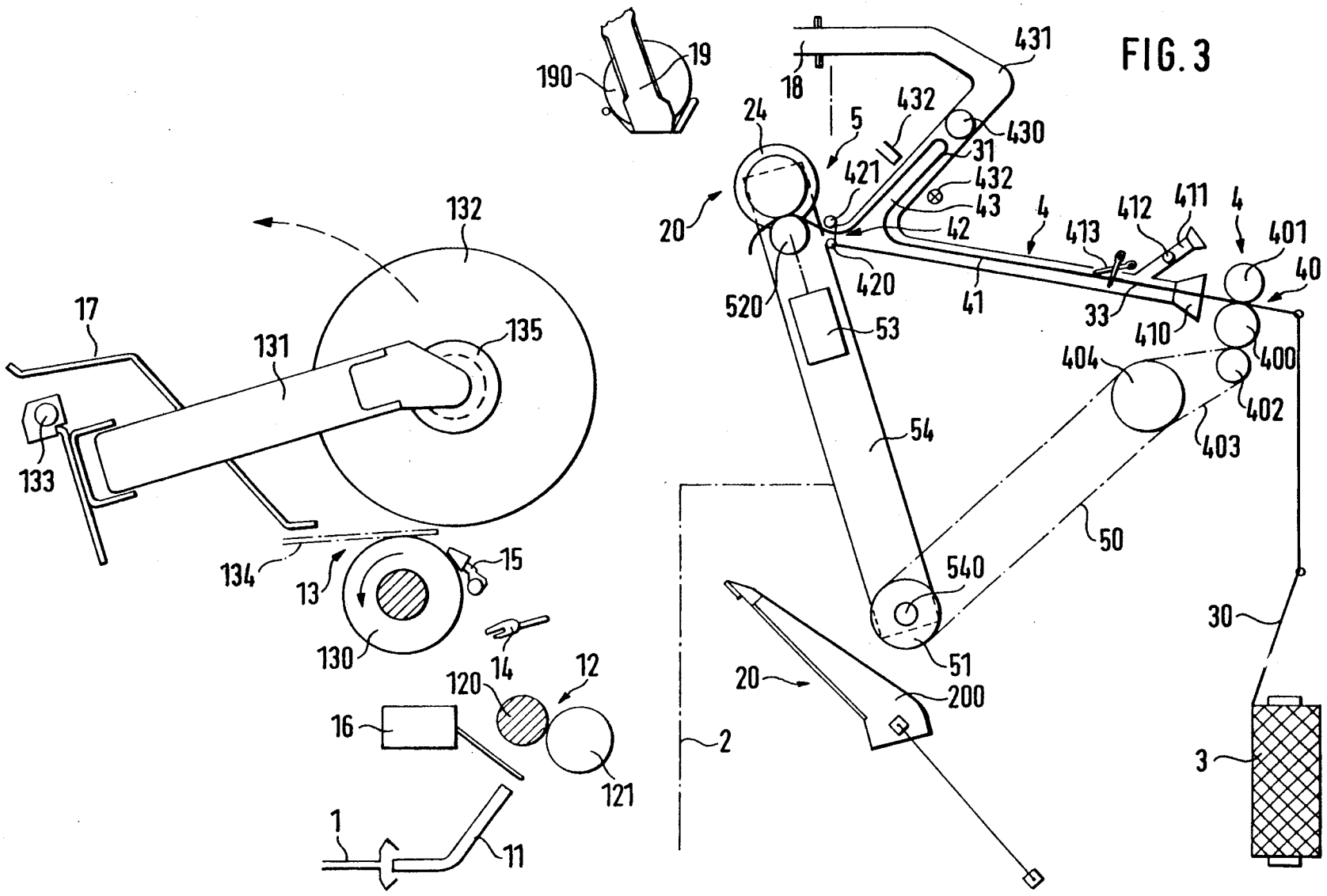

As FIG. 3 also shows, the piecing yarn 30 which continues to be delivered by the pair of delivery rollers 40 constitutes a reserve loop 31 in the suction opening 43. After a predetermined period of time, which is sufficient for the reserve loop 31 to grow to the point where it compensates for the movement of the pair of auxiliary rollers 52 from its position shown in FIG. 3 into the transfer position according to FIG. 4, the pair of delivery rollers 40 is stopped by deactivation of the coupling of the drive wheel 402, so that no more yarn is being fed. At the same time the valve 412 is closed, so that further compressed-air feeding into the yarn guiding pipe 41 is stopped. In addition, the magnetic drive 53 is activated so that the pressure roller 520 comes to bear against the auxiliary drive roller 24 and clamps the leading yarn end.

The pair of delivery rollers 40 being stopped, the yarn clamp 42 is now opened as a result of movable part 421 being lifted from the stationary part 420. With the pair of delivery rollers 40 still stopped, the pivoting lever 54, together with the closed pair of auxiliary rollers 52, is then swivelled away from the yarn guiding pipe 41 and brought into proximity of the winding roller 130 (see FIG. 4). The piecing yarn 30 drawn off from the piecing bobbin 3 thus reaches the proximity of the winding device 13 as this back-feeding takes place, whereby the yarn reserve (reserve loop 31) formed earlier is used up. In this position of the pivoting lever 54 the auxiliary drive roller 24 assumes essentially the same position as during yarn breakage repair, when it drives the bobbin 132 for the back-feeding of the end of a broken yarn 10 (to be described in detail further below). In this position the pair of auxiliary rollers 52 is close to the outlet of the suction nozzle 200, which has been brought in the meantime, into the yarn receiving position shown in FIG. 4. This yarn receiving position of the suction nozzle 200 is identical to that for yarn piecing repair, to be described in greater detail further below.

The coupling of the drive wheel 402 is now engaged once more, so that in addition to the pair of auxiliary rollers 52, the pair of delivery rollers 40 is also driven once more. The drive connections and the diameters of the rollers of the pair of delivery rollers 40 and of the pair of auxiliary rollers 52 are interrelated in such manner that the pairs of rollers 52 and 40 are driven at the same circumferential speed. If necessary, the circumferential speed of the pair of auxiliary rollers 52 may be slightly higher than the circumferential speed of the pair of delivery rollers 40, so that the piecing yarn 30 between these two pairs of rollers 40 and 52 is subjected to a small amount of draft.

The piecing yarn 30 drawn off from piecing bobbin 3 and delivered by auxiliary rollers 52 now comes into the range of action of the suction air stream acting in nozzle 200, into which it is sucked. After a sufficient length of yarn has been sucked into nozzle 200 by the negative pressure therein and by driving the pair of delivery rollers 40 and the pair of auxiliary rollers 52 simultaneously, nozzle 200 is pivoted back from the yarn receiving position shown in FIG. 4 into the rest position shown in FIG. 5. During this motion the piecing yarn 30 comes out of the slot (not shown) facing the winding roller 130 which slot to this end now can be opened whereas it was closed when the yarn was sucked in. During this time, yarn 30 travels along the path **30*a* and reaches the centering spindle 21 which has meanwhile been brought into the operating position shown. The piecing yarn 30 is stretched between the centering spindle 21 and the end of the slot facing the pivot point of suction nozzle 200**.

The piecing yarn 30 is now taken up in a known manner by a pair of rollers (not shown), is cut by a cutting device provided for this pair of rollers to a defined length and is then brought by means of this pair of rollers before the outlet opening of the yarn draw-off pipe 11, whereby the piecing yarn 30 gets on the discharge spindle 25 which has assumed its shown work position (in the meantime) so that a piecing reserve is formed on said discharge spindle 25. The back feeding of the piecing yarn 30 which is jointly effected by means of the pair of delivery rollers 40 and the pair of auxiliary rollers 52 brings said piecing yarn 30 into a readiness position inside the yarn draw-off pipe 11 of the spinning device (see yarn path **30*b* in FIG. 5), in which the yarn end does not yet reach the fiber collecting surface of the spinning element (in form of a spinning rotor 1**, in the shown embodiment).

While the piecing yarn 30 is still in this readiness position for actual piecing, the yarn cutting device 413 is actuated in front of the pair of auxiliary rollers 52, i.e. between the pair of delivery rollers 40 and the pair of auxiliary rollers 52, and the piecing yarn 30 is cut inside the yarn guiding pipe 41. Since the piecing yarn has been cut before the storage, i.e. before the suction opening 43, the yarn end 32 extending to the pair of auxiliary rollers 52 is now sucked up by the suction air stream prevailing in the suction opening 43. The other yarn end 33, extending toward the pair of delivery rollers 40 and held by it, is held in a straight position by the negative pressure effect in the suction opening 43. The compressed air supply to the injection nozzle 411 can be switched off at the latest at this moment, if this did not already occur, once the pressure roller 520 has come to bear against the auxiliary drive roller 24 (see FIG. 3). Since the injection nozzle must only take effect when the pressure roller 520 is lifted off from the auxiliary drive roller 24, the magnetic drive 53 of the pressure roller and the injection nozzle 411 can also be controlled in synchronization by a common control device.

Figure 6:
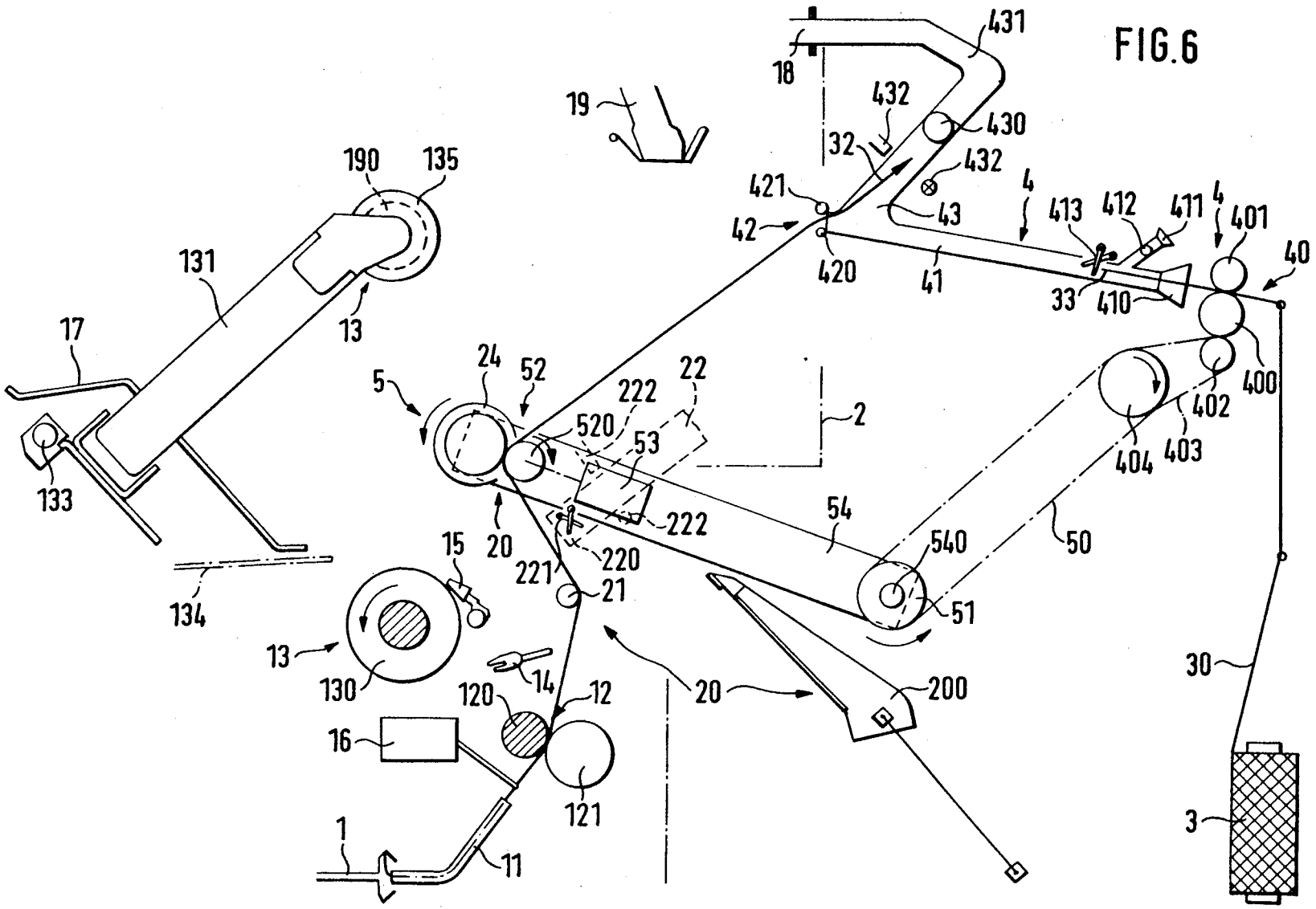

Normally cleaning of the spinning element, which may be in form of a spinning rotor 1, is carried out during the time when the spinning device is being prepared for the piecing process. The spinning rotor which had been stopped earlier, for example during cleaning, is then released once more. While the spinning rotor accelerates, possibly also when a piecing speed which may in some cases be different from the production rotor speed has been reached, actual piecing takes place through discharge of the yarn reserve constituted by the piecing yarn 30 from the discharge spindle. The piecing yarn 30 now goes from the readiness position shown in FIG. 5 to the collection surface of the spinning rotor 1 (see FIG. 6). In timed relationship therewith, fiber feeding is also resumed, so that the yarn end fed back into the spinning rotor 1 now combines with the fibers accumulated in the spinning rotor 1.

When the piecing yarn 30 is discharged by the discharge spindle 25, the piecing yarn 30 enters between the roller 120 and the pressure roller 121 of the pair of draw-off rollers 12 which has been lifted off from it.

Figure 7:
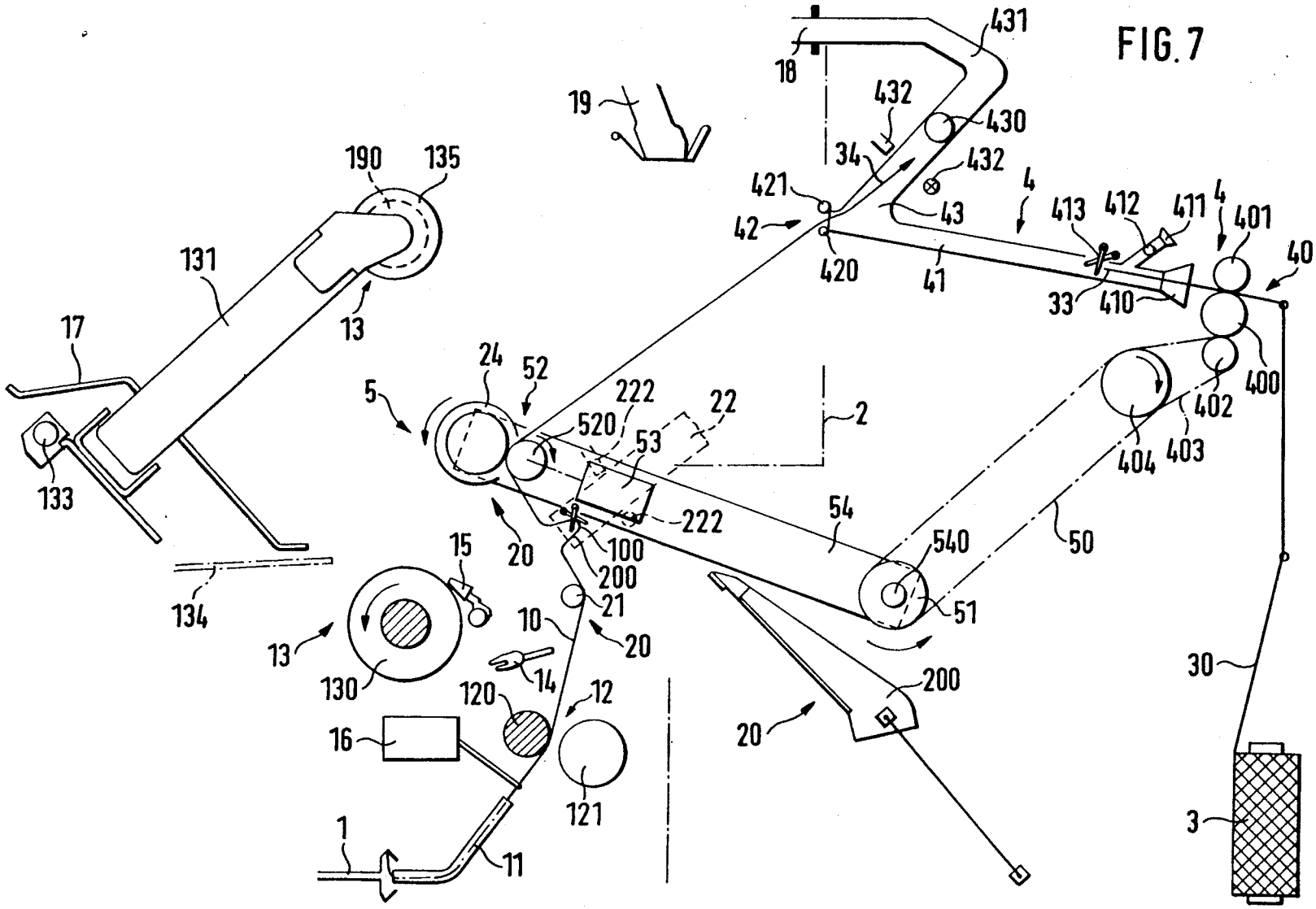

In timed relationship with the discharge of the piecing yarn by the discharge spindle 25, the drive motor 404 is switched on again, but in the opposite direction than before. At the same time the coupling of the drive wheel 402 is activated so that the pair of delivery rollers 40 is not driven by the drive motor 404. The pair of auxiliary rollers 52 now rotates in draw-off direction and draws off the yarn out of the spinning rotor 1 and takes it to the suction opening 43 (see FIG. 6). Thereby, the piecing joint 34 also enters the suction opening 43 (see FIG. 7).

The drive motor 404 is speed-controlled and is gradually accelerated during this piecing process in accordance with a predetermined program until the yarn is finally drawn off at a speed that is exactly equal to the circumferential speed of the driven roller 120 of the pair of draw-off rollers. The pressure roller 121 is now brought to bear against the driven roller 120 of the pair of draw-off rollers 12, so that the yarn is transferred to the pair of draw-off rollers 12 and is now drawn off by the latter from the spinning rotor 1.

The pieced yarn is at first drawn off in this manner through the mechanical feeding device 5 (pair of auxiliary rollers 52) near the winding device 13 from the spinning device and is transferred to the pair of draw-off rollers 12, between the spinning device and the feeding device 5, only later. The rotation imparted to the yarn by the spinning rotor 1 during piecing can thus distribute itself over a great length of the yarn, unless this is prevented by other twist stopping edges, etc. For this reason less twist goes into the spinning rotor 1 and on its fiber collecting surface, so that more time is available for the period between first contact between yarn end and fiber collecting surface, without danger that the yarn might become excessively twisted during piecing, causing it to break.

In the time during which the newly pieced yarn is drawn off from the spinning rotor 1 by the pair of auxiliary rollers 52, the outlet 220 of the suction pipe 22 is presented to the yarn between the pair of auxiliary rollers 52 and the centering spindle 21.

After a period of time of sufficient length to ensure that the piecing joint 34 has gone through the pair of auxiliary rollers 52, said pair of auxiliary rollers 52 is stopped by means of the drive motor 404 or is at least decelerated in comparison with the pair of draw-off rollers 12, so that between the pair of draw-off rollers 12 and the pair of auxiliary rollers 52 an excess of yarn is produced which is sucked into suction pipe 22 in the form of a yarn loop 100. When this yarn loop 100 has reached a sufficient size, so that the newly spun yarn 10 which subsequently is delivered through the a pair of draw-off rollers 12 can be pneumatically held securely by suction pipe 22 by pneumatic means, the cutting device 221 is activated. The outlet 220 of the suction pipe is designed in such manner (or appropriate guides are provided for it) that the portion of the yarn loop 100 which is fed to the pair of auxiliary rollers 52 is within range of the cutting device 221, while the portion of this yarn loop 100 which is closest to the pair of draw-off rollers 12 does not come within range of said cutting device. In this manner it is ensured that the yarn 10 is cut between the yarn loop 100 and the feeding device 5 and that the yarn loop 100 is securely held by the suction pipe 22 even after said yarn loop 100 has been cut. The cut-off yarn end is pulled out of the suction pipe 22 by the pair of auxiliary rollers 52. Upon leaving the pair of auxiliary rollers 52, this cut yarn end is removed through the suction opening 43 (see FIG. 7).

The bobbin arms 131 together with the inserted empty tube 190 are now lowered, so that the tube is again driven by the winding roller 130.

The yarn 10 which is continuously delivered by the pair of draw-off rollers 12 continues to enter into suction pipe 22. The pair of auxiliary rollers 52, which is no longer needed, is moved back into its starting position shown in FIGS. 1. At the same time the magnet drive 53 releases the pressure roller 520, so that the latter can return into its base position.

The centering spindle 21 is now driven, so that it discharges the yarn 10 and transfers it into a guiding form 23 (see FIG. 8) which has first been moved towards the centering spindle 21. At the same time the suction pipe 22 is brought into transfer position in which the yarn 10, running into the suction pipe 22, reaches an area near a catching device (now shown) on a tube plate 135 at the end of one of the bobbin arms 131. In this way the yarn is transferred to the empty tube 190. The yarn 10 subsequently delivered through the pair of draw-off rollers 12 is thus wound up on the empty tube 190, proper control of the guiding fork 23 ensuring that several reserve windings are first formed before the yarn 10 is released by the guiding fork 23 and comes within the lifting range of the cross-winding yarn guide 15, whereupon regular windings are constituted on the tube 190.

In timed relationship with the transfer of the yarn 10 to the catching device on the former plate 135 and thereby to the former 190, the cutting device 221 is again activated in the suction pipe 22, whereby the excess yarn end is severed from the yarn 10 and then removed through the suction pipe 22.

The bobbin replacement process and the piecing process to be carried out in connection with this bobbin replacement process are thereby completed. The elements of the spinning station now again assume their spinning position, as shown in FIG. 1.

All the elements of the piecing device are again brought back into their base position, as seen in FIG. 1. The service unit 2 which is not longer needed at this spinning station now continues to travel to the next spinning station where a service function is to be carried out.

The above-described device to carry out a bobbin replacement and a piecing process to be carried out in this connection is designed so that it does enter the operating area of the back-feeding device 20, so that the latter can be designed in the conventional manner and can function in the conventional manner. The auxiliary drive roller 24 is installed at the interface between the feeding device 5 and the back-feeding device 20 and, for this reason, the auxiliary drive roller 24 is designed at the same time as a component of the pair of auxiliary rollers 52. When a normal yarn breakage, i.e. one that occurs independently from a bobbin replacement, is being repaired, the swiveling lever 54, together with the auxiliary drive roller 24 of the pair of auxiliary rollers 52, is also needed. For the repair of a normal yarn breakage however, the auxiliary drive roller 24 serves to drive the full bobbin 132. For this reason, in case of yarn breakage, auxiliary roller 24 is assigned to bobbin 132 as a driver, the bobbin 132 being lifted off the winding roller 130.

Such a repair of yarn breakage, without simultaneous bobbin replacement, is explained in further detail below.

In the starting position shown in FIG. 1 the yarn 10 is being wound continuously on the bobbin 132. When a yarn breakage occurs, the yarn monitor 16 emits a control impulse causing the supply of fibers into the spinning rotor 1 to be stopped. Furthermore, a control impulse is transmitted to the drive of the bobbin lifting device 134 which releases the latter and brings it into the position shown in FIG. 2.

The service unit 2 now comes to the spinning station in question. This can be achieved based on a call-up signal emitted by the yarn monitor 16; it can be also achieved in that the service unit 2 travels alongside the machine and performs service functions at all those spinning stations which it passes in any case.

Once the service unit 2 has reached a spinning station at which a yarn breakage has occurred it stops. By means of a lifting device (now shown) the bobbin arms 131 are lifted until the bobbin 132 is lifted off from the bobbin lifting device 134, enabling the bobbin 132 to rotate freely. To be able to obtain the yarn length needed for piecing within predetermined tolerances, the not-shown lifting device is designed so that the distance between bobbin 132 and bobbin roller 130 is always the same.

Figure 9:
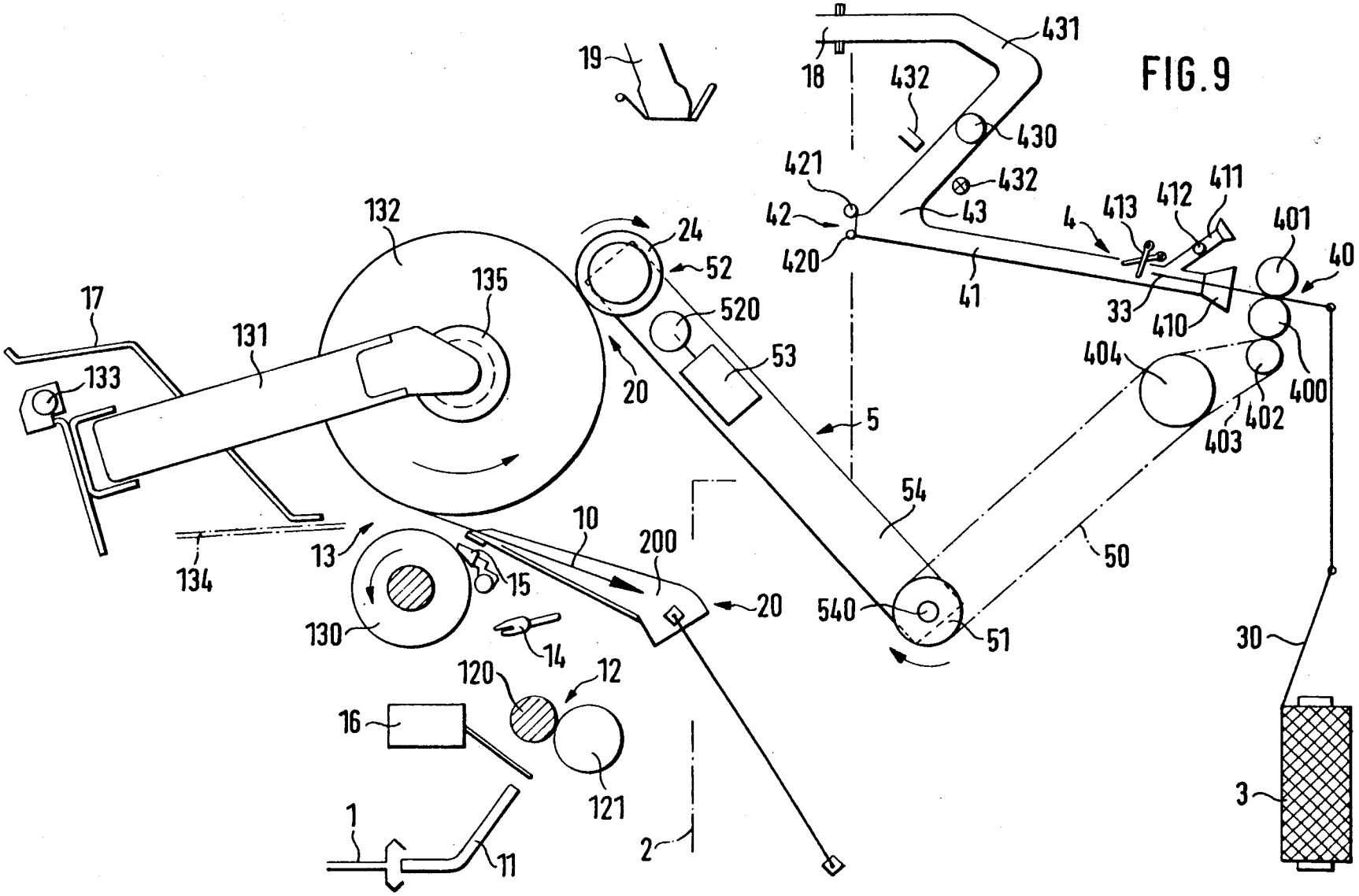
FIGS. 9 and 10 show the device of FIG. 1 in schematic cross-section in different work phases during repair of a yarn breakage.

The pivoting lever 54 is now pivoted in the direction of the bobbin until the auxiliary drive roller 24 comes to bear against the bobbin 132 (FIG. 9). The drive motor 404 is driven so that the bobbin 132 is rotated in the direction opposite to the normal winding direction and so that the suction nozzle 200, which has in the meantime been brought into yarn take-up position, can take up the end of the broken yarn 10 from the bobbin 132. The subsequent operating steps for piecing are identical with those that were previously described through FIGS. 5 and 6 (see FIG. 10). Since the yarn 10 is already connected to the bobbin 132, the operating steps for the transfer of the newly pieced yarn to the bobbin 132 are not necessary (see FIGS. 7 and 8).

Figure 10:
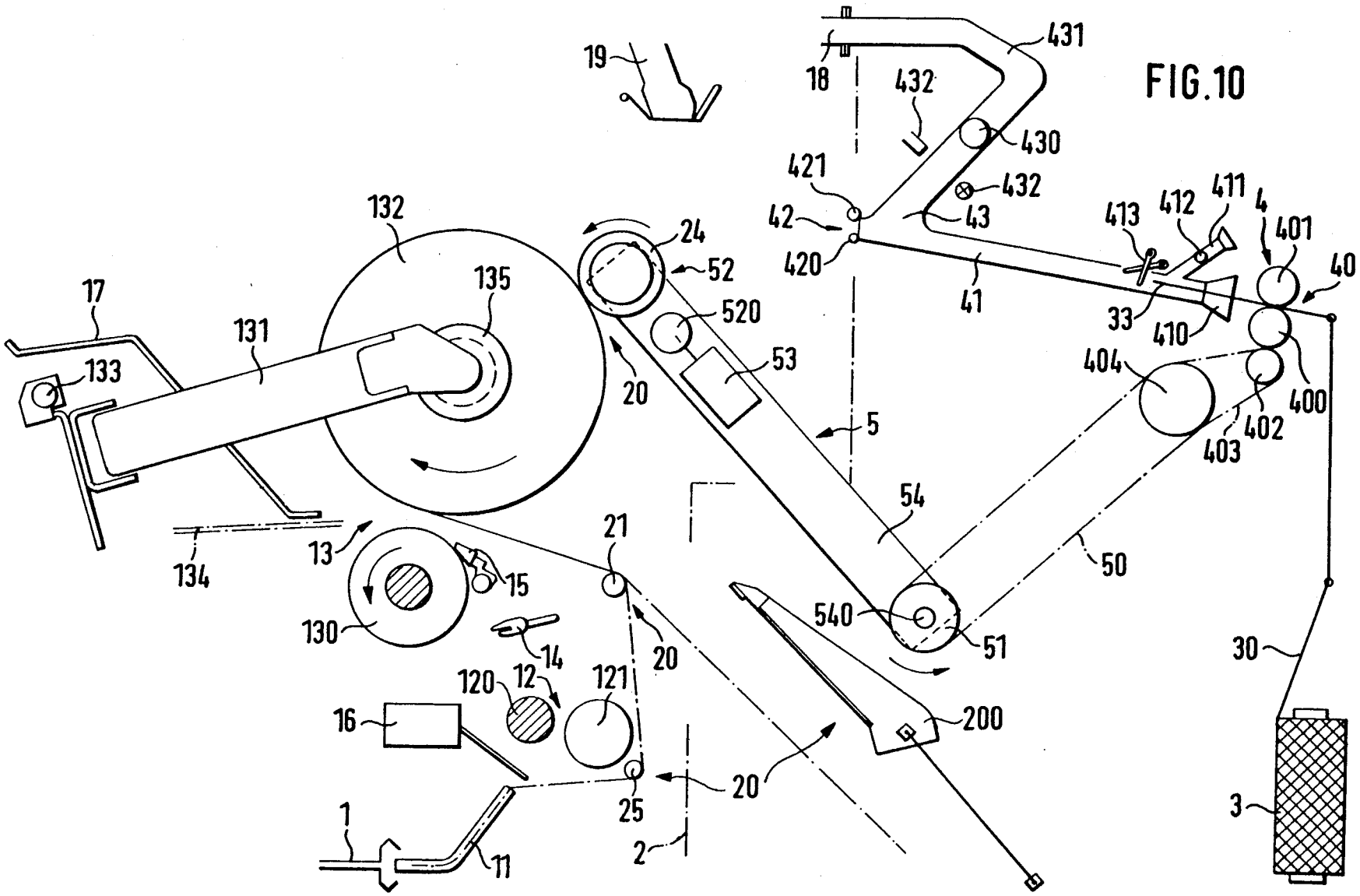

As a comparison between FIG. 4 and FIG. 10 shows, the yarn is fed back between winding device 13 and the spinning device (yarn draw-off pipe 11) along a back-feeding path to the spinning device which is identical in both instances, whether it is back-fed from bobbin 132 or whether it is drawn off from the piecing bobbin 3.

When the bobbin 132, driven by the auxiliary drive roller 24 has reached its normal wind-up speed which is its speed during production, bobbin 132 is brought by the service unit 2 back into contact with the winding roller 130, while the pivoting lever 54, together with the auxiliary drive roller 101 is pivoted back into its base position shown in FIG. 1.

As a comparison between FIG. 9 and FIG. 4 shows, the suction nozzle 200 is in the same position during piecing in connection with a bobbin replacement as during normal yarn breakage repair. In both cases the back-feeding of the yarn 10 or of the piecing yarn 30 to the spinning device is effected by means of the drive of the auxiliary drive roller 24. The other operating steps by which the yarn is fed into the yarn draw-off pipe 11 and into the spinning rotor 1 are identical, with the only difference being that in connection with a bobbin replacement the piecing yarn 30, and later the newly spun yarn, is conveyed by means of the pair of auxiliary rollers 52, and thereby by means of the auxiliary drive roller 24 directly, and in case of yarn breakage repair by means of the auxiliary drive roller 24 indirectly via bobbin 132 in back-feeding or draw-off direction (also see FIG. 10).

The above description clearly shows that the yarn 10 or the piecing yarn 30 are always fed back from the area in which the auxiliary drive roller 24 is in its transfer or bobbin driving position into the spinning rotor 1, along one and the same path. Also the drawing off of the pieced yarn occurs in both instances at the beginning of this common yarn back-feeding path, i.e. in proximity of the winding device 13 in a controlled manner, whereby the control of the draw-off speed is effected in both cases by means of the auxiliary drive roller 24 which at the same time is also a component of the pair of auxiliary rollers 52.

In order to maintain the clarity of the representation of the devices described, the control connections are not shown in the figures. Conventional means can be used to control the different elements.

The control of different methods for the repair of yarn breakage or for bobbin replacement is explained below with reference to FIG. 16. Four programs 60, 61, 62 and 63 are stored in the control device 6 shown in that illustration.

The program 60 controls the normal yarn breakage repair procedure such as has been described through FIGS. 9 and 10. As FIG. 16 shows, this program is initiated by the actuation of the yarn monitor 16.

The bobbin replacement program with subsequent piecing, such as has been described through FIGS. 1 to 8, is contained in program 62. This program is initiated by the actuation of a switch 64. This switch 64 is constituted by a light barrier which scans the diameter of the bobbin 132 or also by a clocking device which monitors the number of revolutions of the roller 120 of the pair of draw-off rollers 12 and finds the length of yarn since the last bobbin replacement. Other devices can also be provided by means of which it can be ascertained whether the bobbin 132 has reached its wanted size.

The drive 642 of a change-over device 643 by means of which the yarn monitor 16 can be connected optionally to the program 60 or to the program 61 is connected to the control circuit 640 between the switch 64 and the program 62 via a connecting circuit 641. This program 61 serves to repair yarn breakage immediately following a completed bobbin replacement. In such case no such yarn length is yet present, as a rule, on the newly inserted empty tube 190, so that new piecing is possible.

In particular, in connection with a bobbin replacement process, the spinning process continues to be supervised for a certain time by the service unit 2. This can be accomplished by means of the earlier-mentioned yarn monitor 16 or by means of a cross-winding supervision device which ascertains whether the pieced yarn is present or whether it does or does not move in a cross-winding movement after a pre-determined period following piecing (as a result of the insertion into the cross-winding yarn guide 15). If this is not the case, the program 61 is initiated. For this the spinning device is stopped once more (interruption of fiber feeding, lifting of the empty tube 190). The empty tube 190 is then emptied. This can be done manually for example, or by bringing the suction nozzle 200 to the lifted and freely rotatable former 190. The pivoting lever 54 is now brought by means of the auxiliary drive roller 24 to bear against the tube 190, so that the few windings which are on the tube 190 can be unwound and sucked away through the suction nozzle 200 while said tube 190 is rotated backwards. A piecing process by means of piecing yarn 30 then takes place, such as has been described earlier through FIGS. 2 to 8, but without effecting a new bobbin replacement. This program 61 can also be designed so that it can still be executed when the service unit 2 has already left the spinning station as a yarn breakage occurs following a bobbin replacement and will eliminate the malfunction only at its next passage in front of that spinning station.

Figure 16:
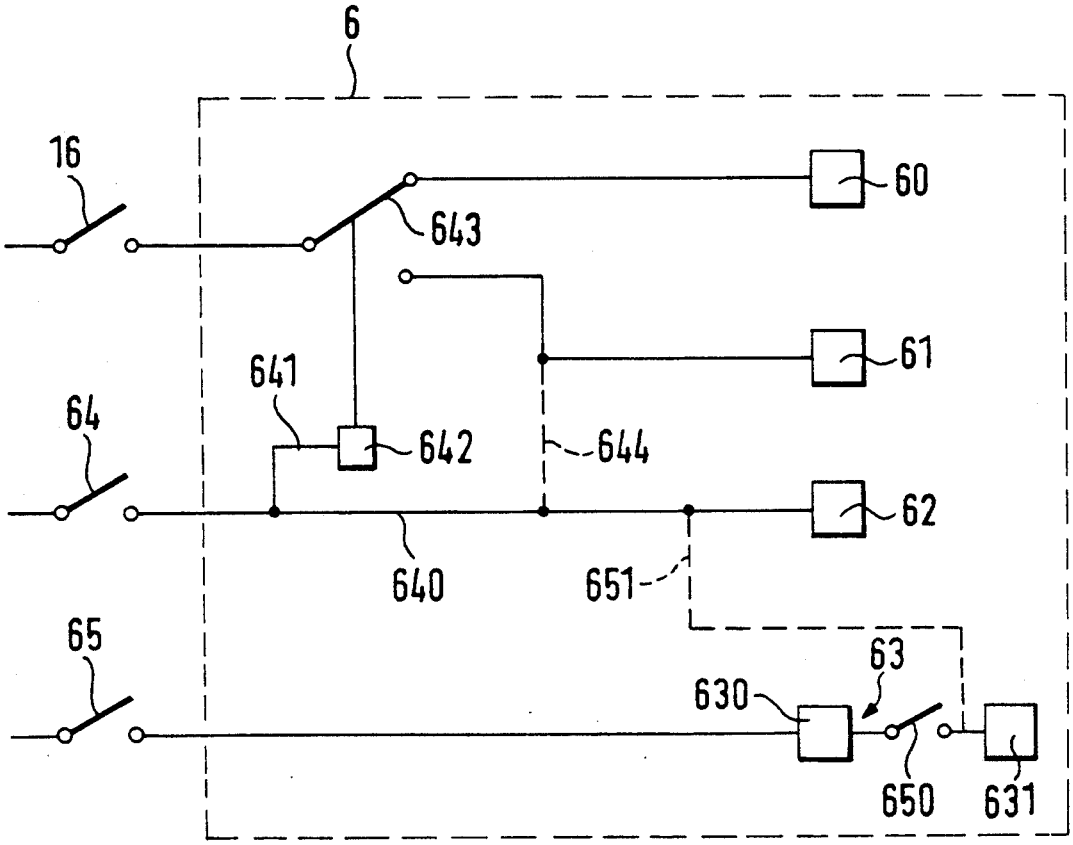
FIG. 16 schematically shows the control device with different program for the repair of yarn breakage and for bobbin replacement.

As shown in FIG. 16, through the control connection 644 indicated by a broken line, the control circuit 540 can also be connected to the yarn monitor 16 by the change-over device 643. In that case the program 61 is not used, so that when yarn breakage occurs following a bobbin replacement, another bobbin replacement is carried out, whereby tube 190, with a few windings it contains, is removed.

In order to be able to find out at an early moment if a piecing attempt fails, the suction pipe 22 as well as the suction circuit 431 are equipped with a monitoring unit 222 or 432 which monitors the pieced yarn, as shown in FIGS. 1 to 10.

These monitoring units 222 and 432 are activated within the framework of piecing supervision at times when a yarn must extend into the suction pipe 22 (see work phase according to FIG. 8), or must extend into the suction circuit 431 (see work phases according to FIGS. 3, 6 and 7), both of which constitute a yarn removal device and remove the yarn, before its transfer to the winding device 13. If it found that the yarn is missing, piecing is interrupted and a new piecing process is a initiated. Such monitoring devices 222 and 432 can also find lap formations on the pair of draw-off rollers 12, since in that case, while the yarn monitor 16 detects the absence of normal draw-off tension, it is the monitoring device 222 and/or the monitoring device 432 which detects the missing yarn.

The monitoring device can be designed in a known manner, e.g. in form of a light barrier. It is, however, advantageous if the monitoring device is able to distinguish between a stopped (axially immobile) and a moving (axially mobile) yarn, i.e. if it is made in form of a yarn movement monitoring device. If the yarn is monitored for axial movement, faults occurring after the beginning of yarn removal by the suction pipe 22 or by the suction circuit 431, for instance a catching of the yarn, are also recorded.

In some cases one single monitoring device 222 or 432 is sufficient, and it is indicated in that case to locate this single monitoring device near the end of the yarn path, i.e. near the winding device 13. The closer to the end of the yarn path (e.g. inside the suction opening 43 or the suction circuit 431) the monitoring device 432 is located, the greater number of faults can be monitored by this monitoring device.

It has been shown that when a batch is to be replaced, it is best not to effect any normal bobbin replacement in the manner described above through FIGS. 1 to 8. To ensure that fiber remnants of the old batch cannot be incorporated into the new yarn during the spinning process following the batch replacement it is advantageous to clean the spinning machine and the individual spinning stations first. For this reason the replacement of bobbins in connection with batch replacement is carried out in two steps. At first, the first phase 630 of program 63 is initiated by actuating a switch 65, whereby a yarn breakage is produced by stopping the fiber feeding device and whereby the full bobbins 132 are then ejected from the winding devices 13 of the different spinning stations. Following this, the spinning machine is stopped and the individual spinning devices are prepared for the new batch, including in particular a cleaning of the machine or a new adjustment of the piecing device in the service unit 2. Once this is accomplished, actuation of the switch 650 initiates the second phase 631 of the program 63. In this phase 631 the empty tubes 190 are inserted into the winding devices 13 and piecing is carried out with the piecing yarn 30, as described above.

As indicated in FIG. 16 through the control connection 651, the phase 631 of the program 63 can be identical with the program 62. In that case a program as described through FIGS. 1 to 8 is carried out in this second phase 631. However an ejection of the full bobbins 132 no longer occurs, as this ejection of the bobbins 132 has already occurred in the preceding phase 630.

The different programs 60, 61, 62 and 63 can be called up, as described above, depending on whether a yarn breakage has occurred in connection with a bobbin replacement or independently of it, or whether a bobbin replacement is to be carried out in connection with a batch replacement or independently of it.

It goes without saying that locking devices which are not shown here, such as diodes, etc., prevent the individual programs 61, 62 and 63 from becoming mixed up in an undesirable manner. Such safety features were not shown in FIG. 16, for the sake of clarity.

The described device can be varied in many ways by replacing elements with equivalents or by other combinations.

Figure 12:
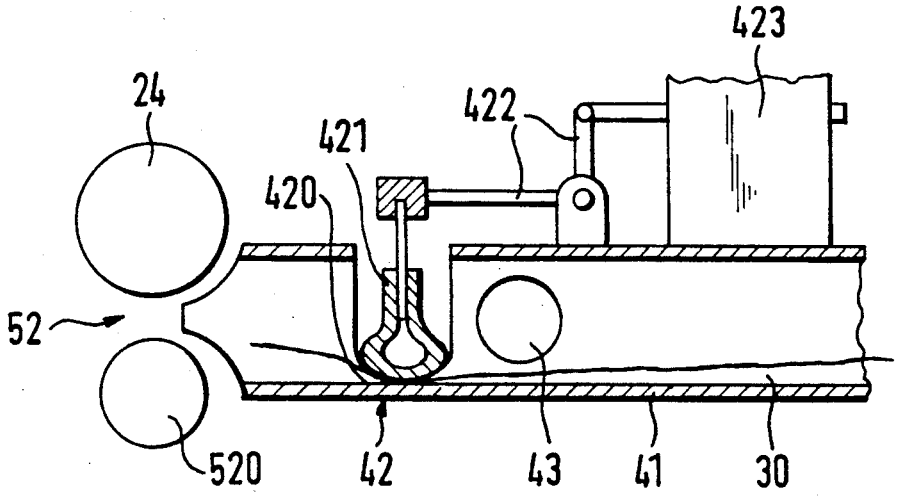
FIG. 12 shows a longitudinal section of the end of the yarn guiding pipe shown in FIGS. 1 to 10 on the side of the auxiliary pair of rollers.

Another embodiment of the yarn guiding pipe 41 and of the yarn clamp 42 is shown in FIG. 12. In order for the piecing yarn 30 to be guided into immediate proximity of the pair of auxiliary rollers 52 so as to ensure secure insertion of the yarn in the pair of auxiliary rollers 52, the end of the yarn guiding pipe 51 on the side of the pair of auxiliary rollers 52 is adapted to the shape of the nip of said pair of auxiliary rollers 52.

In principle it is also possible to install the yarn clamp 42 in proximity of the yarn guiding pipe 41, between the latter and the pair of auxiliary rollers 52, but installing it inside this yarn guiding pipe 41 is especially favorable to good yarn guidance.

To retain the yarn securely, part 420 of the yarn clamp 42 is formed by the interior wall of the yarn guiding pipe 41 according to FIG. 12, while the moving part 421 of the yarn clamp 42 is formed by an element made of an elastic material which is held by a pivoting lever 422. This pivoting lever 422 is supported on the yarn guiding pipe 41 and is connected for control to a solenoid 423 by means of which the elastic part 421 can be brought into and out of operating position.

The above-described device is suitable for the production of cylindrical as well as for the production of conical bobbins. In the latter case it is necessary for the casing line of the auxiliary drive roller 24 to extend parallel to the casing line of the bobbin 132. This can be achieved in that the pair of auxiliary rollers 52 is attached to the pivoting lever 54 in such manner that it can be pivoted and adjusted.

Figure 11:
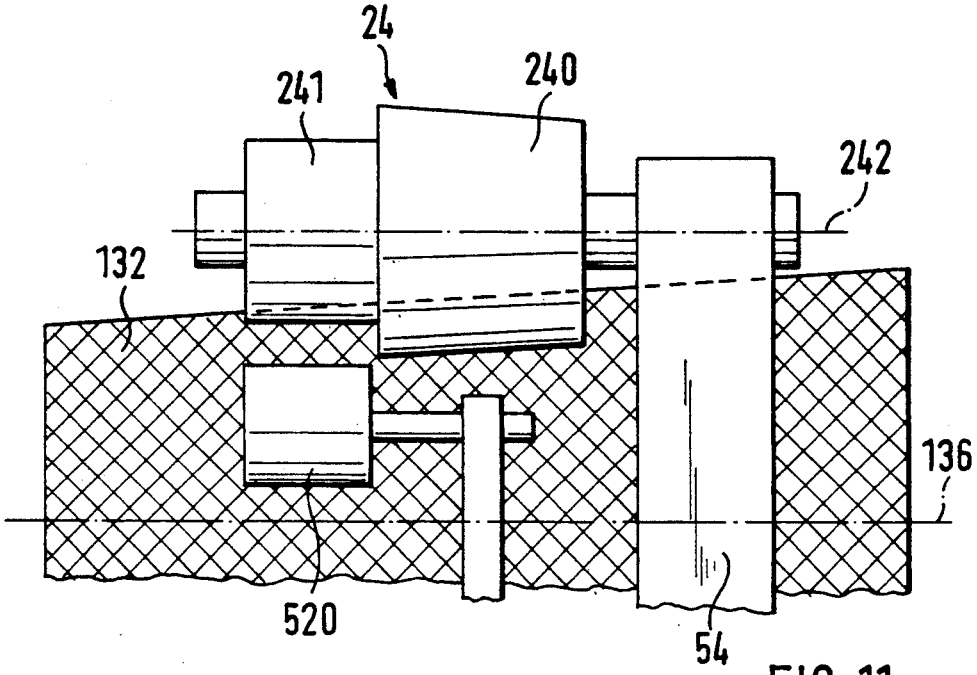
FIG. 11 shows a frontal view of the auxiliary pair of rollers in bobbin-driving position.

Another design of the pair of auxiliary rollers 52 is shown in FIG. 11. In this embodiment the auxiliary drive roller 24 has two longitudinal segments 240 and 241. The first longitudinal segment 240 has a greater diameter than the second longitudinal segment 241 and is also adapted to the conicity of the bobbin 132. Therefore, if the bobbin 132 is cylindrical, the longitudinal segment 240 is also cylindrical. If, on the other hand, the bobbin 132 is conical, the longitudinal segment also has conicity in such manner that the axes 136 and 242 of bobbin 132 and of the auxiliary drive roller 24 are parallel. While the longitudinal segment 240 interacts with the bobbin 132, the longitudinal segment 241 with the smaller diameter is provided for interaction with the pressure roller 520. When a change-over is made from a particular bobbin configuration to another it is only necessary to replace the auxiliary drive roller 24 with another auxiliary drive roller 24 the longitudinal segment 240 of which is designed in adaptation to the bobbin configuration to be produced.

Since the auxiliary drive roller 24 serves to control the piecing draw-off for yarn breakage repair as well as for bobbin replacement, where the piecing draw-off is effected in one instance by bobbin 132 and in the other instance by the auxiliary drive roller 24, the diameters of the two longitudinal segments 240 and 241 and the speed at which the auxiliary driver roller 24 is driven by the drive motor 404 for yarn breakage repair or for bobbin replacement are related to each other and controlled in such manner that the yarn is always drawn off from the spinning station at the same draw-off speed during piecing. This is achieved when the circumferential speed of the first longitudinal segment 240 is equal during yarn breakage repair to the circumferential speed of the second longitudinal segment 241 during piecing in connection with a bobbin replacement by controlling the drive means. If a bobbin 132 of a different shape (cylindrical or conical, or even of divergent conicity) is to be produced, it suffices to replace the auxiliary drive roller 24 for adaptation. Setting the pair of auxiliary rollers 52 at a different angle or exchanging the pressure roller 520 is not necessary however.

In case of a conical configuration of the first longitudinal segment 240, the second longitudinal segment 241 can in principle be adjacent either the smaller or the larger diameter. If the second longitudinal segment 241 is made adjacent to the larger diameter of the first longitudinal segment of the auxiliary drive roller 24, the danger is minimal, even in case of a small diameter difference, for this second longitudinal segment 241 to come into contact with the circumference of the bobbin 132, so that uncertain drive conditions are avoided even in case of small diameter differences.

In principle it does not matter whether the auxiliary drive roller 24 or the pressure roller 520 interacting with it is closer to the pivoting axis 540. An installation of the auxiliary drive roller 24 in proximity of the free end of the pivoting lever, however, offers greater constructive clearance. Neither is it absolutely necessary to design the pressure roller 520 so that it can be lifted off from the auxiliary drive roller 24, since the piecing yarn 30 can be guided into the nip of the pair of auxiliary rollers 52 and can be made to come out of it again by appropriately driving the pair of auxiliary rollers 52. If necessary, an additional coupling can be provided for the pair of auxiliary rollers 52.

To avoid having to search anew on the piecing bobbin 3 for the piecing yarn 30 for every piecing operation for the execution of which it is needed by such means as a suction nozzle for example, similar to the suction nozzle 200, the piecing yarn 30 is guided through a yarn retention device. In the above-described embodiment this yarn retention device is constituted by the pair of delivery rollers 40. This pair of delivery rollers 40 makes it also possible to convey the yarn in a controlled manner to the feeding device 5.

To convey the piecing yarn 30 into the above-mentioned common back-feeding path a stationary pair of auxiliary rollers 52 to which the piecing yarn 30 is conveyed by other mechanical or pneumatic means could be considered. However, it is particularly simple for this to provide (as shown) a pivoting arm 54 or another movable element for the pair of auxiliary rollers 52 which is moved from a yarn take-up position (FIG. 1) into a yarn transfer position (FIG. 4). In order to avoid synchronization between the action of the pair of delivery rollers 40 and the action of the pair of auxiliary rollers 52 and the movement of the pivoting lever, a reserve loop 31 is constituted before the mechanical feeding device 5 in accordance with the described embodiment design, the reserve loop 31 being used up during such a feeding movement of the feeding device 5.

According to the described embodiment, the presenting device 4 is provided with a pneumatic yarn feeder upstream of the pair of auxiliary rollers 52 in form of a yarn guiding pipe 41 extending from the pair of delivery rollers 40 to the pair of auxiliary rollers 52. Alternately, however, it is also possible to provide a pneumatic yarn feeder in form of a pivoting suction pipe or a compressed air nozzle which can be brought into play between pair of delivery rollers 40 and pair of auxiliary rollers 52 and which is directed upon the nip of the pair of auxiliary rollers 52 in order to feed the piecing yarn 30 to said pair of auxiliary rollers 52.

If a storage device for the compensation of the yarn feeding movement of the feeding device 5 is installed upstream of the latter (between pair of delivery rollers 40 and pair of auxiliary rollers 52), it can also be of mechanical design, in the manner of a conventional storage device. If such a storage device is of pneumatic design, it can be stationary and installed between pair of delivery rollers 40 and pair of auxiliary rollers 52 or can be brought temporarily into this area for its function. To save air, it may be possible to switch it on and off by means of a switching device (valve 430).

The source of negative pressure for such a piecing device can be located on the service unit 2 itself; however, the suction opening 43 of the pneumatic storage can also be connected via suction circuit 18 to a source of negative pressure (not shown) on the machine side, as indicated in FIGS. 1 to 10.

Another embodiment of a presenting device 4 by means of which the piecing yarn 30 is brought mechanically into the pair of auxiliary rollers 52 and mechanically from the latter into the previously mentioned yarn back-feeding path is described below through FIGS. 13 to 15. While the retention device in the previously described embodiment consists of a pair of delivery rollers 40, a mechanical storage device 44 into which the yarn 30 which was pulled from the piecing bobbin 3 is guided in zig-zag is provided for this according to FIGS. 13 to 15. This storage unit 44 is equipped with two comb-like elements 440 and 441 which are under spring tension and tend to move away from each other and to build up a yarn reserve.

On the side of the storage unit 44 away from the piecing bobbin 3 is pivoting lever 45, rotating around an axis 450, which is provided with a yarn clamp 451 that can be opened and closed at its end.

The pivoting lever 54, together with the pair of auxiliary rollers 52, and the pivoting lever 45, together with the yarn clamp 451, are supported in such manner that the yarn clamp 451 can be brought selectively to one or the other side of the air of auxiliary rollers 52 which has been brought into yarn receiving position. This can be seen by comparing FIGS. 13 and 14.

Figure 13:
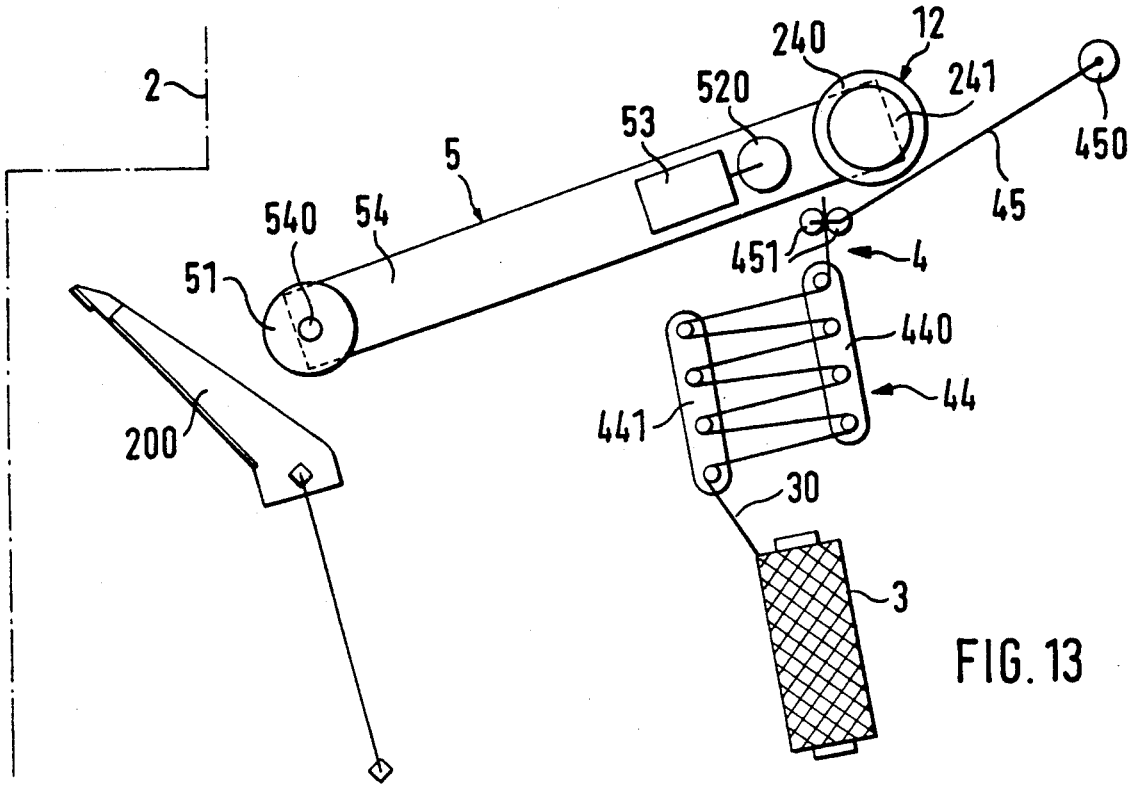
FIGS. 13 to 15 show another embodiment of the device according to the invention in different work phases.

In their starting position the pivoting lever 54 and the pivoting lever 45 assume the position shown in FIG. 13. The yarn clamp 451 holds the beginning of the piecing yarn 30 while the pair of auxiliary rollers 52 is in yarn receiving position in front of the leading end of the piecing yarn 30.

Figure 14:
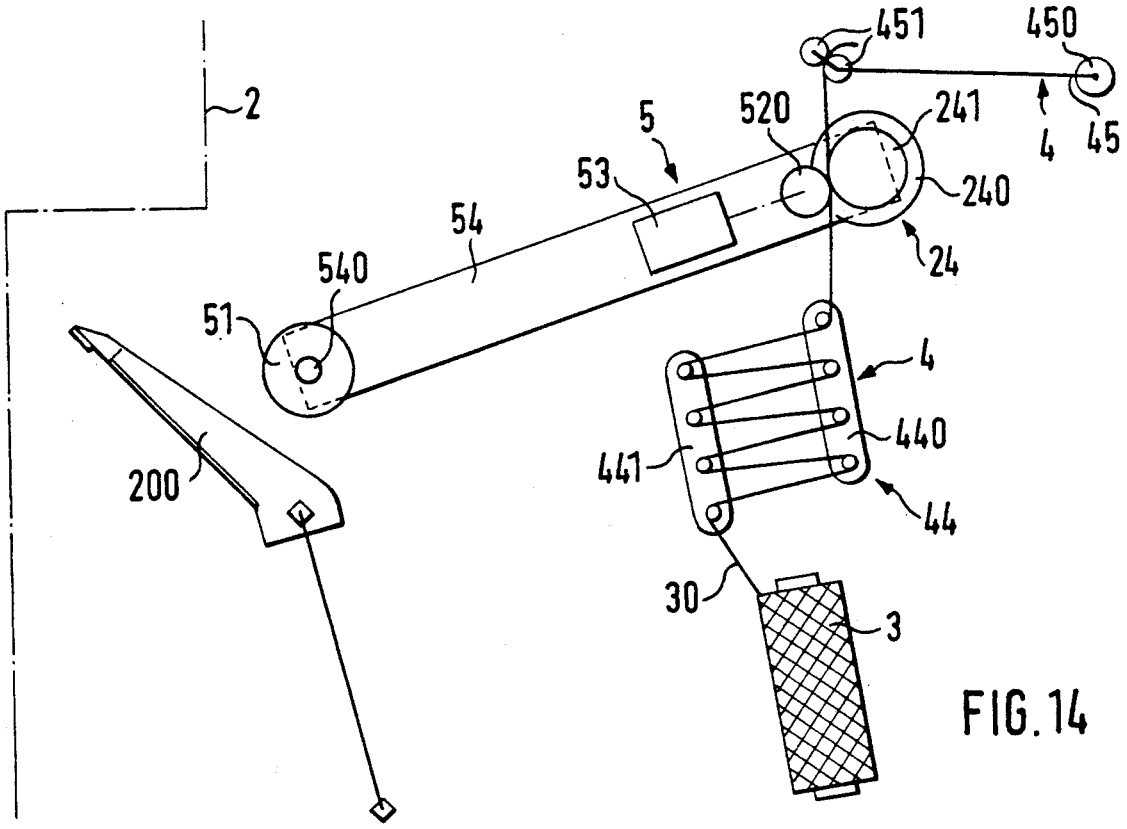

Through an appropriate movement of the pivoting arm 45 the yarn clamp 451 is brought to the side of the pair of auxiliary rollers 52 away from the storage device 44, whereupon the pressure roller 520 is brought to bear against the auxiliary drive roller 24 and the yarn clamp 451 is opened (see FIG. 14).

As the pivoting arm 45 pivots, the piecing yarn is braked by the storage device 44 to prevent the spinning yarn 30 from being drawn off in an uncontrolled manner from piecing bobbin 3. At the same time the yarn reserve stored in the storage device 44 is decreased until, after completion of the pivoting motion of the pivoting lever 45, the yarn reserve grows once more to its full size due to resumed draw-off of the piecing yarn from the piecing bobbin 3.

Figure 15:
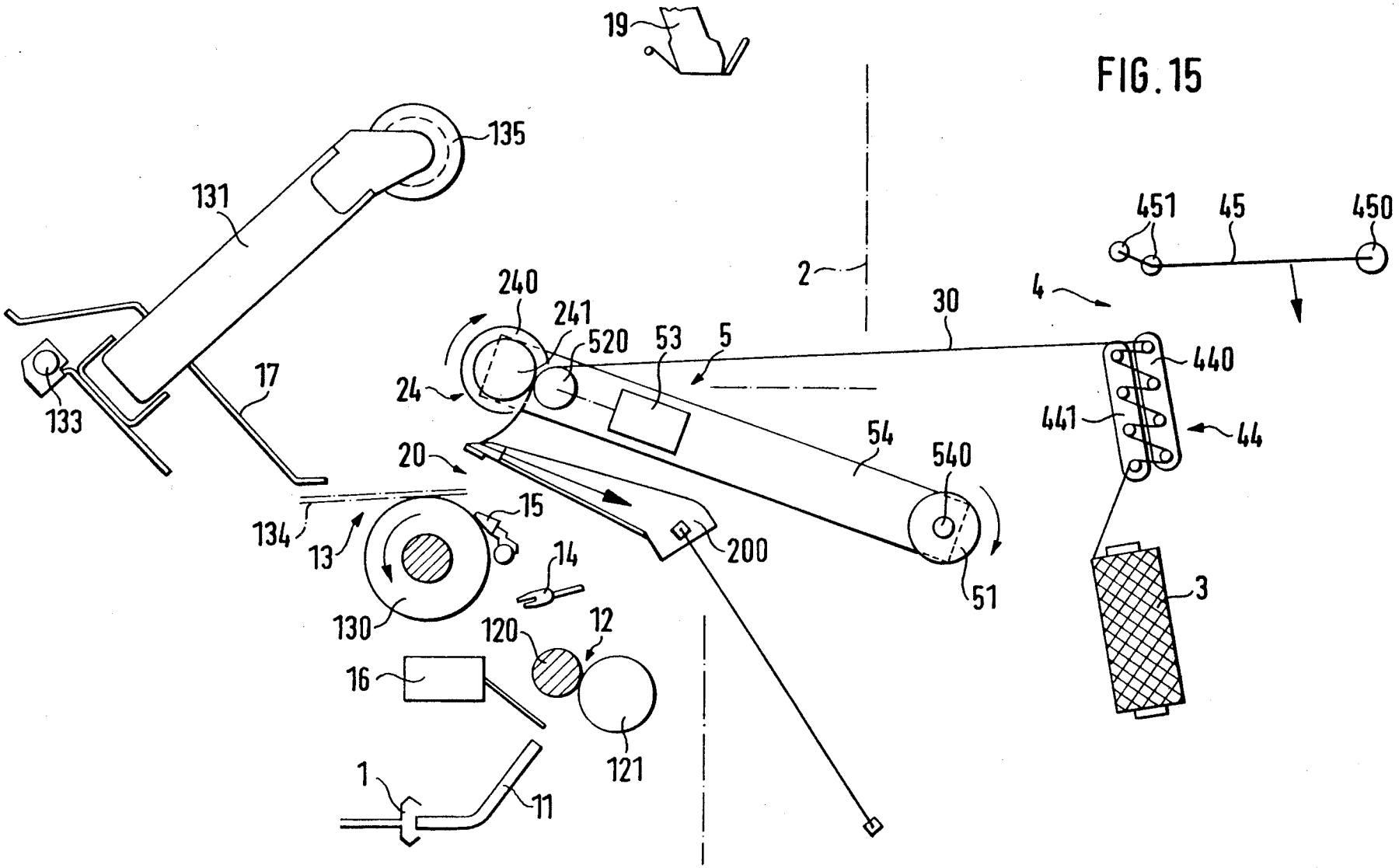

After the piecing yarn 30 has been received by the pair of auxiliary rollers 52, the pair of auxiliary rollers is brought into the transfer position through pivoting of the arm 54 (see FIG. 15, compare with FIG. 4). At the same time the yarn reserve provided in the storage device 44 is used up. The continued process of yarn back-feeding and piecing is identical with the one which was described through FIGS. 4 to 8. However, care is taken here that the piecing yarn 30 does not leave the nip of the pair of auxiliary rollers 52 during this piecing operation.

Until completion of the piecing operation the pivoting arm 54, together with the piecing yarn 30 held in the pair of auxiliary rollers 52 returns into the position shown in FIG. 13. The pivoting lever 54 is now also brought into the position shown in FIG. 13 and in this position receives the beginning of the piecing yarn 30. The yarn length released as the pivoting arm 54 returns into its yarn receiving position (according to FIG. 13) is stored in the storage device 44.

If a yarn breakage is to be repaired, as is done by means of the yarn unwound from bobbin 132, the pivoting arm 54 can be pivoted toward the bobbin, together with the auxiliary drive roller 24, since the end of the piecing yarn 30 is held in the yarn clamp 451.

In principle, a piecing device according to one of the above-described embodiments can be provided for each spinning station. In the service units 2 generally used today which travel alongside a plurality of spinning devices of an open-end spinning machine however, the piecing bobbin, the presenting device 4, the feeding device 5 and the back-feeding device 20 are installed on said service unit 2 and service is number of feeding stations.

What is claimed is:

1. A process for piecing yarn on an open-end spinning machine which has machine draw-off rollers, a spinning device, and a yarn winding device and in which yarn from either the winding device bobbin would up during the spinning process or from a special piecing bobbin is fed back into the spinning device over the same back-feeding path, comprising the steps of:

(a) grasping the end of the special piecing yarn from said special piecing bobbin with a pair of auxiliary rollers mounted on the end of a pivotable lever and pivoting said lever to move said end of said piecing yarn to a point near the beginning of the back-feeding path and in proximity with said winding device wherein one of the auxiliary rollers is positioned so that it can drive the winding bobbin;

(b) moving said piecing yarn end with a back-feeding device from said point back to said spinning device along a predetermined path which coincides with the same back-feeding path of yarn drawn off the bobbin on said winding device;

(c) piecing said piecing yarn end in said spinning device;

(d) using the auxiliary rollers to subject said pieced yarn to a controlled draw-off effect at a draw-off speed less than the normal draw-off speed of the machine draw-off rollers during spinning operations;

(e) increasing said draw-off speed of the auxiliary rollers to the normal draw-off speed and subjecting said pieced yarn to normal draw-off effects only after the normal draw-off speed is attained;

(f) trimming said pieced yarn with the piecing joint; and (g) transferring said trimmed yarn to an empty tube located in the winding device.

2. A process as set forth in claim 1 wherein said piecing yarn is braked by the piecing bobbin during draw-off.

3. A process as set forth in claim 1, wherein a full bobbin replacement operation is carried out in two steps whereby said full bobbin is ejected from said winding device in the first step and an empty tube is inserted into the winding device only after said piecing process has been initiated by yarn drawn off said special piecing bobbin.

4. A process as set forth in claim 1, wherein said piecing process includes the steps of, in connection with a bobbin replacement, monitoring the transfer of said piecing yarn to the empty tube for a predetermined period of time and stopping said spinning device when a yarn breakage occurs during said predetermined period of time, and wherein the winding of yarn onto said tube during the preceding process is unwound and said piecing process is repeated without replacing said bobbin.

5. A process as set forth in claim 4, wherein said yarn is monitored during the piecing process.

6. A process as set forth in claim 5, wherein said yarn is monitored in proximity of the winding device.

7. A process as set forth in claim 5, wherein said yarn is monitored for axial movement.

8. A device for piecing yarn on an open-end spinning machine having a spinning device and a winding device with a winding roller for driving a winding bobbin, comprising:

(a) a back-feeding device for feeding a yarn end to said spinning device;
(b) a piecing bobbin having a supply of piecing yarn;
(c) means for lifting said winding bobbin from contact with said winding roller when yarn piecing is required;
(d) a feeding device for delivering an end of said piecing yarn to said back-feeding device;
(e) a presenting device for delivering a yarn end from said piecing bobbin to said feeding device; and
(f) said feeding device having a pair of auxiliary rollers, one of which is driven and disposed on the free end of a lever pivotable between said presenting device and a position from which to drive said winding bobbin when said winding bobbin is lifted off said winding roller.

9. A device as set forth in claim 8, wherein the other of said pair of auxiliary rollers includes means for movement away from said drive roller.

10. A device as set forth in claim 8, wherein said drive roller of said auxiliary pair of rollers is replaceable and is provided with a first segment for driving said winding bobbin which has a shape adapted to that of the winding bobbin and a second longitudinal segment which cooperates with the other roller of said pair of auxiliary rollers.

11. A device as set forth in claim 8, further comprising a presenting device having a yarn retention device.

12. A device as set forth in claim 11, wherein said presenting device is provided with a pair of driven delivery rollers.

13. A device as set forth in claim 12, wherein a common drive motor drives said pair of delivery rollers and said pair of auxiliary rollers.

14. A device as set forth in claim 13, wherein the driven rollers of said pair of delivery rollers and said pair of auxiliary rollers are driven at the same effective circumferential speed.

15. A device as set forth in claim 12, wherein said presenting device is provided with a storage device.

16. A device as set forth in claim 15, wherein said storage device is made in the form of a suction chamber which is disposed between said pair of delivery rollers and said pair of auxiliary rollers.

17. A device as set forth in claim 16, wherein said storage chamber is connected to a source of negative air pressure on said machine.

18. A device as set forth in claim 15, wherein said storage device is disposed adjacent to said auxiliary rollers.

19. A device as set forth in claim 12, wherein said presenting device is provided with a pneumatic yarn feeder disposed upstream of said pair of auxiliary rollers.

20. A device as set forth in claim 11, wherein said piecing bobbin said presenting device, said feeding device, and said back-feeding device, are disposed on a service unit which travels alongside a plurality of adjacent opening open-end spinning devices on said open-end spinning machine.

21. A device as set forth in claim 8, wherein said device is controlled by a control device that has a plurality of control programs adapted to control said piecing device whether yarn breakage occurs in connection with bobbin replacement or independently thereof or whether bobbin replacement is to be carried out in connection with a batch replacement or independently thereof.

22. A device as set forth in claim 8, wherein said piecing device comprises a monitoring device which monitors the pieced yarn.

23. A device as set forth in claim 22, wherein said monitoring device is disposed adjacent to a yarn removal device, used to remove said yarn before its transfer to said winding device.

24. A device as set forth in claim 23, further comprising: a yarn storage chamber wherein said monitoring device is disposed in said yarn storage chamber.

25. A device as set forth in claim 22, wherein said monitoring device is able to distinguish between an axially immobile and an axially mobile yarn.

26. A process for piecing yarn on an open-end spinning machine which has a spinning device and a yarn winding device and in which yarn is fed back into the spinning device from either the winding device bobbin wound up during the spinning process or from a special piecing bobbin, comprising the steps of:

(a) feeding the piecing yarn mechanically to an air stream which introduces said piecing yarn into the open nip of a pair of auxiliary rollers;
(b) stopping said piecing yarn in proximity of its advance end and forming a loop of said yarn from said yarn which continues to be delivered;
(c) stopping the continued delivery of said piecing yarn;
(d) moving said pair of auxiliary rollers with its nip closed to a point in proximity with said winding device and into range of a suction air stream while the yarn loop is consumed;
(e) moving said yarn end to said spinning device along a predetermined path which coincides with the back-feeding path of yarn drawn off the bobbin on said winding device;
(f) feeding said piecing yarn back into a readiness position within said spinning device by driving said pair of auxiliary rollers to draw-off said piecing yarn from said piecing bobbin, whereby a piecing yarn reserve is formed with its advanced end;
(g) cutting said piecing yarn before the auxiliary pair of rollers, as seen in the conveying direction to form a trailing end of said piecing yarn;
(h) subjecting said trailing yarn end extending towards said pair of auxiliary rollers to a stream of suction air;
(i) piecing said yarn by resuming the fiber feeding and releasing the piecing reserve;
(j) using said pair of auxiliary rollers to subject said pieced yarn to a controlled draw-off effect at a draw-off speed less than the normal draw-off speed during spinning operations, whereupon the pieced yarn is conveyed to said suction air stream;
(k) increasing said draw-off speed to the normal draw-off speed and subjecting said pieced yarn to normal draw-off effects only after the normal draw-off speed is attained;
(l) transferring said pieced yarn between said spinning device and said pair of auxiliary rollers to a pair of draw-off rollers;

(m) decelerating said pair of auxiliary rollers thereby causing a yarn loop to be formed between said auxiliary rollers and said draw-off rollers, holding said yarn loop pneumatically and severing said loop from the yarn end extending above said suction air stream so that said piecing joint is removed and a new yarn end is formed on said pieced yarn; and (n) transferring said newly formed yarn end to an empty tube which has been inserted in said winding device.

27. A device for piecing yarn on an open-end spinning machine having a spinning device and a winding device with a winding roller for driving a winding bobbin, comprising:

(a) a back-feeding device for feeding a piecing yarn end to said spinning device;

(b) a piecing bobbin having a supply of piecing yarn;

(c) means for lifting said winding bobbin from contact with said winding roller when yarn piecing is required;

(d) a feeding device for delivering an end of said piecing yarn to said back-feeding device, said feeding device having a pair of auxiliary rollers, one of which is driven and movable to a position to drive said winding bobbin when said winding bobbin is lifted off said winding roller, said driven auxiliary roller being replaceable and having a first segment for driving said winding bobbin which has a shape adapted to that of the winding bobbin and a second longitudinal segment which cooperates with the other auxiliary roller of said pair of auxiliary rollers, said first segment having a larger diameter than said second segment; and (e) control means for controlling said driven roller in such a manner that the circumferential speed of said first longitudinal segment during the piecing of a yarn breakage is equal to the circumferential speed of said second longitudinal section during piecing in connection with winding bobbin replacement.

28. A device as set forth in claim 27, wherein said first longitudinal segment is conical and said second longitudinal segment is cylindrical and follows the larger diameter of said first longitudinal segment.

29. A device for piecing yarn on an open-end spinning machine having a spinning device and a winding device with a winding roller for driving a winding bobbin, comprising:

(a) a back-feeding device for feeding a piecing yarn end to said spinning device;

(b) a piecing bobbin having a supply of piecing yarn;

(c) means for lifting said winding bobbin from contact with said winding roller when yarn piecing is required;

(d) a feeding device for delivering an end of said piecing yarn to said back-feeding device, said feeding device having a pair of auxiliary rollers, one of which is driven and movable to a position to drive said winding bobbin when said winding bobbin is lifted off said winding roller;

(e) a presenting device having a pair of driven delivery rollers and a suction storage chamber disposed between said pair of delivery rollers and said pair of auxiliary rollers, and having a stationary opening for said suction storage chamber, said opening being disposed in proximity of said auxiliary pair of rollers and between said auxiliary rollers and said delivery rollers; and (f) valve means for controlling said opening for said suction storage chamber.

30. A device as set forth in claim 29, wherein a yarn cutting means is disposed before said suction storage chamber, in the yarn conveying direction.

31. A device as set forth in claim 30, wherein said yarn cutting means is located between said pair of delivery rollers and said suction storage chamber.

32. A device as set forth in claim 30, wherein said yarn cutting device is disposed within a yarn guiding pipe.

33. A device for piecing yarn on an open-end spinning machine having a spinning device and a winding device with a winding roller for driving a winding bobbin, comprising:

(a) a back-feeding device for feeding a piecing yarn end to said spinning device;

(b) a piecing bobbin having a supply of piecing yarn;

(c) means for lifting said winding bobbin from contact with said winding roller when yarn piecing is required;

(d) a feeding device for delivering an end of said piecing yarn to said back-feeding device, said feeding device having a pair of auxiliary rollers, one of which is driven and movable to a position to drive said winding bobbin when said winding bobbin is lifted off said winding roller; and (e) a presenting device having a yarn retention device, a pair of driven delivery rollers, and a pneumatic yarn feeder disposed upstream of said pair of auxiliary rollers, said pneumatic yarn feeder having a yarn guiding pipe extending from said pair of delivery rollers to said auxiliary pair of rollers.

34. A device as set forth in claim 33, further comprising a storage chamber opening laterally into the end of said yarn guiding pipe nearest to said pair of auxiliary rollers.

35. A device as set forth in claim 33, wherein said yarn retention device includes a yarn clamping means disposed remotely from said pair of delivery rollers adjacent the end of said yarn guiding pipe.

36. A device as set forth in claim 35, wherein said yarn clamping means is located inside said yarn guiding pipe.

37. A device as set forth in claim 35, wherein said yarn clamping means includes a movable clamping element comprising an elastic material.

38. A device as set forth in claim 33, wherein said yarn guiding pipe is shaped at its end nearest said pair of auxiliary rollers to conform to the nip of said pair of auxiliary rollers.

39. A device for piecing yarn on an open-end spinning machine having a spinning device and a winding device with a winding roller for driving a winding bobbin, comprising:

(a) a back-feeding device for feeding a piecing yarn end to said spinning device;

(b) a piecing bobbin having a supply of piecing yarn;

(c) means for lifting said winding bobbin from contact with said winding roller when yarn piecing is required;

(d) a feeding device for delivering an end of said piecing yarn to said back-feeding device, said feeding device having a pair of auxiliary rollers, one of which is driven and movable to a position to drive said winding bobbin when said winding bobbin is lifted off said winding roller; and (e) a presenting device having a yarn retention device, a pair of driven delivery rollers, and a compressed air nozzle directed upon the nip of said auxiliary rollers and being selectively activated at a point between said delivery rollers and said auxiliary rollers.

40. A device as set forth in claim 39, wherein said presenting device includes a yarn guiding pipe, and said compressed air nozzle comprises an injection nozzle which opens into the end of said yarn guiding pipe adjacent said delivery rollers.

41. A device as set forth in claim 39, further comprising means for lifting off the non-driven roller of said auxiliary pair of rollers from said driven roller of said auxiliary pair of rollers, and a control for controlling each of said lifting means and said compressed air nozzle.

* * * * *